US010485355B2

(12) United States Patent
Yu et al.

(10) Patent No.: US 10,485,355 B2
(45) Date of Patent: Nov. 26, 2019

(54) AIR MATTRESS SYSTEM AND CONTROLLING METHOD OF AIR MATTRESS SYSTEM

(71) Applicant: iOBED INC., Gyeonggi-do (KR)

(72) Inventors: Young Jun Yu, Gyeonggi-do (KR); Dong Hun Lee, Chungcheongnam-do (KR); Keon Yong Lee, Gyeonggi-do (KR); Dong Wook Shin, Gyeonggi-do (KR); Seung Mo Kim, Seoul (KR)

(73) Assignee: iOBED INC., Gyeonggi-do (KR)

( * ) Notice: Subject to any disclaimer, the term of this patent is extended or adjusted under 35 U.S.C. 154(b) by 0 days.

(21) Appl. No.: 16/041,884

(22) Filed: Jul. 23, 2018

(65) Prior Publication Data

US 2019/0075931 A1 Mar. 14, 2019

(30) Foreign Application Priority Data

Sep. 11, 2017 (KR) ..... 10-2017-0115955

(51) Int. Cl.
*A47C 27/08* (2006.01)
*A47C 27/10* (2006.01)
*A61G 7/057* (2006.01)

(52) U.S. Cl.
CPC ..... *A47C 27/083* (2013.01); *A47C 27/084* (2013.01); *A47C 27/10* (2013.01); *A61G 7/05769* (2013.01); *A61G 2203/34* (2013.01)

(58) Field of Classification Search
CPC ..... A47C 27/08; A47C 27/081; A47C 27/082; A47C 27/083; A47C 27/10; A61G 7/05769; A61G 7/05776
USPC ..... 5/710, 713, 706, 644, 654, 655.3
See application file for complete search history.

(56) References Cited

U.S. PATENT DOCUMENTS 3,870,450 A * 3/1975 Graebe ..... A61G 7/05769 425/269
4,005,236 A * 1/1977 Graebe ..... A47C 27/081 428/72
4,541,136 A * 9/1985 Graebe ..... A47C 27/081 5/655.3
4,698,864 A * 10/1987 Graebe ..... A47C 27/081 297/DIG. 3
4,982,466 A * 1/1991 Higgins ..... A47C 27/082 5/713

(Continued)

FOREIGN PATENT DOCUMENTS

KR 2003-0061267 A 7/2003
KR 10-2010-0022706 A 3/2010

(Continued)

*Primary Examiner* — Robert G Santos
(74) *Attorney, Agent, or Firm* — The PL Law Group, PLLC

(57) ABSTRACT

An air mattress system includes an air mattress configured to self-adjust its own pressure, a user terminal receiving a set value or user information from a user and transmitting the set value or the user information to the air mattress, and a server receiving measurement data from the air mattress to analyze a sleep pattern and sleep quality of a user and transmitting the analyzed sleep pattern and sleep quality to the user terminal, wherein the air mattress is configured such that the air mattress is divided into multiple sections and the pressure is adjusted for each section based on the set value or the user information.

12 Claims, 17 Drawing Sheets

(56) References Cited

U.S. PATENT DOCUMENTS 5,052,068 A * 10/1991 Graebe ..... A47C 7/021 297/452.23
5,062,169 A * 11/1991 Kennedy ..... A47C 27/082 5/713
5,163,196 A * 11/1992 Graebe ..... A61G 5/1043 5/654
5,533,220 A * 7/1996 Sebag ..... A61G 7/05707 5/654
6,550,085 B2 * 4/2003 Roux ..... A47C 27/081 5/654
6,684,430 B2 * 2/2004 Roux ..... A47C 27/081 5/654
9,370,457 B2 * 6/2016 Nunn ..... A61G 7/015
9,392,879 B2 * 7/2016 Nunn ..... G05B 23/0267
9,510,688 B2 * 12/2016 Nunn ..... A47C 27/083
9,635,953 B2 * 5/2017 Nunn ..... A47C 27/083
9,844,275 B2 * 12/2017 Nunn ..... A47C 21/003
10,092,242 B2 * 10/2018 Nunn ..... A61B 5/6891
10,149,549 B2 * 12/2018 Erko ..... A47C 27/083
10,182,661 B2 * 1/2019 Nunn ..... A47C 27/083
10,194,753 B2 * 2/2019 Fleury ..... A47C 27/083
10,201,234 B2 * 2/2019 Nunn ..... G05B 23/0267
10,251,490 B2 * 4/2019 Nunn ..... A47C 27/083
10,362,882 B2 * 7/2019 Yu ..... A47C 27/082
2002/0013967 A1 * 2/2002 Roux ..... A47C 27/081 5/654
2003/0131417 A1 * 7/2003 Roux ..... A47C 27/081 5/654
2014/0259417 A1 * 9/2014 Nunn ..... A61G 7/015 5/614
2014/0259418 A1 * 9/2014 Nunn ..... A47C 21/003 5/617
2014/0259433 A1 * 9/2014 Nunn ..... A47C 27/083 5/713
2014/0259434 A1 * 9/2014 Nunn ..... A47C 27/083 5/713
2014/0277611 A1 * 9/2014 Nunn ..... G05B 23/0267 700/79
2014/0277778 A1 * 9/2014 Nunn ..... A47C 27/083 700/282
2014/0277822 A1 * 9/2014 Nunn ..... A61B 5/6892 700/301
2015/0026896 A1 * 1/2015 Fleury ..... A47C 27/083 5/713
2015/0157137 A1 * 6/2015 Nunn ..... G05B 23/0267 5/706
2016/0015184 A1 * 1/2016 Nunn ..... A47C 27/10 700/282
2016/0100696 A1 * 4/2016 Palashewski ..... A47C 31/00 700/90
2016/0192886 A1 * 7/2016 Nunn ..... A61B 5/6891 700/282
2017/0003666 A1 * 1/2017 Nunn ..... G08C 17/02
2017/0035212 A1 * 2/2017 Erko ..... A47C 27/083
2017/0196369 A1 * 7/2017 Nunn ..... A47C 27/083
2019/0021513 A1 * 1/2019 Nunn ..... A47C 27/10
2019/0029597 A1 * 1/2019 Nunn ..... A61B 5/6891
2019/0075931 A1 * 3/2019 Yu ..... A47C 27/083
2019/0075932 A1 * 3/2019 Yu ..... A47C 27/10
2019/0104858 A1 * 4/2019 Erko ..... A47C 27/083
2019/0125095 A1 * 5/2019 Nunn ..... A47C 27/083
2019/0125097 A1 * 5/2019 Nunn ..... G05B 23/0267
2019/0200777 A1 * 7/2019 Demirli ..... A47C 21/003
2019/0201265 A1 * 7/2019 Sayadi ..... A47C 21/003
2019/0201266 A1 * 7/2019 Sayadi ..... A47C 21/003
2019/0201267 A1 * 7/2019 Demirli ..... A47C 21/003
2019/0201268 A1 * 7/2019 Sayadi ..... A47C 21/003
2019/0201269 A1 * 7/2019 Sayadi ..... A47C 21/003
2019/0201270 A1 * 7/2019 Sayadi ..... A47C 21/003
2019/0201271 A1 * 7/2019 Grey ..... A47C 21/003
2019/0209405 A1 * 7/2019 Sayadi ..... A47C 21/003
2019/0231084 A1 * 8/2019 Nunn ..... A47C 21/04

FOREIGN PATENT DOCUMENTS

KR 10-2014-0122063 A 10/2014
KR 10-2016-0133967 A 11/2016
KR 10-2017-0065856 A 6/2017
KR 10-2017-0079765 A 7/2017
WO WO 2013/085264 A1 6/2013
WO WO-2019107657 A1 * 6/2019
WO WO-2019107658 A1 * 6/2019
WO WO-2019107659 A1 * 6/2019
WO WO-2019107660 A1 * 6/2019

* cited by examiner $$\frac{(a\times time)+(b\times time)+(c\times time)}{time}=\frac{(a\times 4)+(b\times 2)+(c\times 3)}{9}$$

AIR MATTRESS SYSTEM AND CONTROLLING METHOD OF AIR MATTRESS SYSTEM

CROSS-REFERENCE TO RELATED APPLICATION AND CLAIM OF PRIORITY

This application claims priority to Korean Patent Applications No. 10-2017-0115955 filed on Sep. 11, 2017 in the Korean Intellectual Property Office (KIPO), the entire disclosure of which is incorporated by reference herein.

TECHNICAL FIELD

The present invention relates to an air mattress system and a controlling method of the air mattress system, wherein pressure adjustment of the mattress is possible for each part of a user's body.

BACKGROUND ART

In general, a mattress for a bed is a spring type mattress having a coil spring therein. However, the spring type mattress is problematic in that impacts applied to a local area of the mattress are transmitted to a surrounding area thus causing vibration. The spring type mattress is also problematic in that elasticity of the coil spring is set at the time of manufacturing so that a user may not arbitrarily adjust a degree of cushioning, and elasticity of the coil spring may be deteriorated after long-term use of the mattress.

In an effort to overcome the drawbacks of such a spring type mattress, an air mattress filled with air is used.

An air mattress is generally configured to have air injected thereinto to provide proper cushioning due to air pressure formed therein. The air mattress is comprised of a cushion portion having multiple air pockets, a bottom plate bonded to a lower surface of the cushion portion, and a frame assembly supporting a side surface of the cushion portion.

However, the air mattress in the related art is problematic in that changing of air pressure set at the time of manufacturing may be impossible. Thus, adjusting of pressure of the mattress for each part of a user's body depending on a user's body type may be impossible, and adjusting of air pressure of the mattress depending on user's health condition may be impossible.

Furthermore, the air mattress may be depressed at an upper portion due to the weight of a user, thereby failing to function properly as an air mattress.

Furthermore, it may be difficult for a user to adjust pressure of the air mattress as desired.

Furthermore, measuring and analyzing a sleep pattern and sleep quality of a user may be impossible.

SUMMARY

Accordingly, the present invention has been made keeping in mind the above problems occurring in the related art, and an objective of the present invention is to provide an air mattress system and a controlling method of the air mattress system, wherein pressure adjustment of a mattress is possible for each part of a user's body.

Another objective of the present invention is to provide an air mattress system and a controlling method of the air mattress system, wherein pressure adjustment of a mattress is possible depending on body condition and health condition of a user.

A further objective of the present invention is to provide an air mattress system and a controlling method of the air mattress system, wherein an upper portion of an air pocket is protected such that the air pocket is prevented from being depressed due to the weight of a user.

A yet further objective of the present invention is to provide an air mattress system and a controlling method of the air mattress system, wherein an air mattress interlocks with a user terminal such that a user controls the air mattress.

A still further objective of the present invention is to provide an air mattress system and a controlling method of the air mattress system, wherein analyzing of a sleep pattern and sleep quality of a user is possible.

In order to accomplish the above objectives, according to one aspect of the present invention, there is provided an air mattress system, including: an air mattress configured to self-adjust its own pressure; a user terminal 30 receiving a set value or user information from a user and transmitting the set value or the user information to the air mattress 10; and a server 50 receiving measurement data from the air mattress 10 to analyze a sleep pattern and sleep quality of a user and transmitting the analyzed sleep pattern and sleep quality to the user terminal 30, wherein the air mattress 10 is configured such that the air mattress 10 is divided into multiple sections and the pressure is adjusted for each section based on the set value or the user information.

Furthermore, the air mattress 10 may include: an air pocket unit 11 including multiple air pockets 110 each having a hollow portion formed therein and configured to inflate due to air inflow or to deflate due to air outflow; a body portion 12 into which the air pocket unit 11 is inserted; a mattress controller 13 mounted at the body portion 12 and controlling pressure of the air pocket unit 11; a pressure sensor unit 14 measuring the pressure of the air pocket unit 11 in real time; and an air pump 15 supplying air into the air pockets 110.

Furthermore, the air pocket unit 11 may be divided into: a first section 11-1 where a user's shoulder is located and formed by at least one row of the air pocket unit 11; a second section 11-2 where a user's waist is located and formed by at least one row of the air pocket unit 11; a third section 11-3 where user's buttocks are located and formed by at least one row of the air pocket unit 11; and a fourth section 11-4 where user's thighs and knees are located and formed by multiple rows of the air pocket unit 11.

Furthermore, the pressure sensor unit 14 may measure the pressure of the air pockets 110 for each section of the first section 11-1, the second section 11-2, the third section 11-3, and the fourth section 11-4.

Furthermore, the air mattress 10 may include: a sleep time measuring unit 18 measuring a sleep time based on a time that the user uses the air mattress 10; a pressure change amount calculating unit 19 calculating a pressure change amount of the air pocket unit 11 based on a pressure measurement value measured in real time by the pressure sensor unit 14 during the sleep time of the user; and a pressure adjustment amount calculating unit 20 calculating a pressure adjustment amount based on the calculated pressure change amount such that the pressure of the air pocket unit 11 is within an optimum air pocket pressure range ranging from a preset lower limit value to a preset upper limit value that are determined based on the set value and the user information.

Furthermore, in a section of the multiple sections where the pressure change amount is equal to or greater than the preset upper limit value, the pressure adjustment amount calculating unit 20 may calculate the pressure adjustment amount such that the pressure of the air pockets 110 in the corresponding section is less than the preset upper limit value, and in a section of the multiple sections where the pressure change amount is equal to or less than the preset lower limit value, the pressure adjustment amount calculating unit may calculate the pressure adjustment amount such that the pressure of the air pockets 110 in the corresponding section is greater than the preset lower limit value.

Furthermore, the mattress controller 13 may allow the air of the air pockets 110 to be discharged in the section of the multiple sections where the pressure change amount is equal to or greater than the preset upper limit value, based on the pressure adjustment amount calculated by the pressure adjustment amount calculating unit 20, and may allow the air to be supplied to the air pockets 110 in the section of the multiple sections where the pressure change amount is equal to or less than the preset lower limit value, based on the pressure adjustment amount calculated by the pressure adjustment amount calculating unit 20, whereby the pressure of the air pockets 110 is controlled to be within the optimum air pocket pressure range.

Furthermore, the server 50 may include: a sleep pattern analyzing unit 54 receiving the measurement data including the pressure measurement value, the pressure change amount, the sleep time, and the pressure adjustment amount for each section from the air mattress 10 and analyzing the sleep time and a sleep posture based on the measurement data; and a sleep quality analyzing unit 55 receiving the measurement data including the pressure measurement value, the pressure change amount, the sleep time, and the pressure adjustment amount for each section from the air mattress 10, classifying a sleep state of the user into a deep sleep state, a light sleep state, and a wake state, determining the sleep state based on the measurement data, and scoring the sleep quality.

Furthermore, the sleep pattern analyzing unit 54 may analyze the sleep posture of the user by measuring, by the pressure sensor unit 14, the pressure in each section where the pressure increases, wherein it may be determined that the user lies on his or her side when the pressure change amount of the first section 11-1 is greater than the pressure change amount of other sections, and it may be determined that the user lies on his or her back when the pressure change amount of the third section 11-3 is greater than the pressure change amount of other sections, whereby a main sleep posture taken by the user during the sleep time, and time per sleep posture are analyzed.

Furthermore, the sleep quality analyzing unit 55 may determine that the user is in the deep sleep state when an average change rate of the pressure change amount of the entire section of the air pockets 110 is within a preset range A, may determine that the user is in the light sleep state when the average change rate of the pressure change amount of the entire section of the air pocket unit 11 is within a preset range B, and may determine that the user is in the wake state when the average change rate of the pressure change amount of the entire section of the air pocket unit 11 is within a preset range C.

Furthermore, the sleep quality analyzing unit 55 may assign a score to each of the ranges A, B, and C according to the average change rate of the pressure change amount of the entire section of the air pocket unit 11 and may calculate an average value based on the sleep time to score the sleep quality of the user, wherein a score a may be assigned to the preset range A, a score b may be assigned to the preset range B, and a score c may be assigned to the preset range C.

Furthermore, the air mattress 10 may further include a custom pressure calculating unit 21, wherein when the user lies on the air mattress 10, the custom pressure calculating unit 21 may measure a user's load for each section based on an initial pressure measurement value measured by the pressure sensor unit 14 and calculates a pressure adjustment amount according to the user based on the user information or the measured load for each section.

According to another aspect of the present invention, there is provided a controlling method of an air mattress system that includes an air mattress 10 including an air pocket unit 11 that is configured with multiple air pockets 110 and divided into multiple sections, a user terminal 30, and a server 50, the controlling method including: a set value information receiving step s100 of receiving, by the air mattress 10, a set value or user information transmitted from the user terminal 30 through a mattress communication unit 16; an initial pressure adjusting step s200 of adjusting, by a mattress controller 13, pressure of the air pockets 110 in each of the multiple sections of the air pocket unit 11 based on the received set value or user information; a pressure measuring step s300 of measuring, by a pressure sensor unit 14, the pressure of the air pockets 110 in real time for each section, the pressure of the air pockets changing depending on a movement of a user; a pressure change amount calculating step s400 of calculating, by a pressure change amount calculating unit 19, a pressure change amount based on a pressure measurement value measured in real time; a pressure adjustment amount calculating step s500 of calculating, by a pressure adjustment amount calculating unit 20, a pressure adjustment amount based on the calculated pressure change amount; a pressure adjusting step s600 of controlling, by the mattress controller 13, the pressure of the air pockets 110 based on the pressure adjustment amount calculated by the pressure adjustment amount calculating unit 20; a sleep information analyzing step s700 of receiving, by the server 50, measurement data including the pressure measurement value, the pressure change amount, a sleep time, and the pressure adjustment amount for each section from the air mattress 10 to analyze a sleep pattern and sleep quality of a user; and an information providing step s800 of receiving, by the user terminal 30, user's sleep information analyzed by the server 50 to provide the sleep information to the user.

Furthermore, the air pocket unit 11 may be divided into: a first section 11-1 where a user's shoulder is located and formed by at least one row of the air pocket unit 11; a second section 11-2 where a user's waist is located and formed by at least one row of the air pocket unit 11; a third section 11-3 where user's buttocks are located and formed by at least one row of the air pocket unit 11; and a fourth section 11-4 where user's thighs and knees are located and formed by multiple rows of the air pocket unit 11, and in the initial pressure adjusting step s200, the pressure measuring step s300, the pressure change amount calculating step s400, the pressure adjustment amount calculating step s500, and the pressure adjusting step s600, pressure measurement or pressure adjustment of the air pockets 110 may be performed for each section of the multiple sections.

Furthermore, in the pressure adjusting step s600, based on the pressure adjustment amount calculated by the pressure adjustment amount calculating unit 20, the mattress controller 13 may allow the air of the air pockets 110 to be discharged in a section of the multiple sections where the pressure change amount is equal to or greater than a preset upper limit value such that the pressure of the air pockets 110 in the corresponding section is less than the preset upper limit value, and may allow the air to be supplied to the air pockets 110 in a section of the multiple sections where the pressure change amount is equal to or less than a preset lower limit value such that the pressure of the air pockets 110 in the corresponding section is greater than the preset lower limit value.

Furthermore, the sleep information analyzing step s700 may include: a sleep pattern analyzing step s710 of analyzing, by the server 50, a sleep posture and the sleep time based on the measurement data received from the air mattress 10.

Furthermore, in the sleep pattern analyzing step s710, the sleep pattern analyzing unit 54 may analyze the sleep posture of the user by measuring, by the pressure sensor unit 14, the pressure in each section where the pressure increases, wherein it may be determined that the user lies on his or her side when the pressure change amount of the first section 11-1 is greater than the pressure change amount of other sections, and it may be determined that the user lies on his or her back when the pressure change amount of the third section 11-3 is greater than the pressure change amount of other sections, whereby a main sleep posture taken by the user during the sleep time, and time per sleep posture are analyzed.

Furthermore, the sleep information analyzing step s700 may include: a sleep quality analyzing step s730 of dividing, by the server 50, a sleep state of the user into a deep sleep state, a light sleep state, and a wake state based on the measurement data received from the air mattress 10, determining the sleep state based on the measurement data, and analyzing the sleep quality.

Furthermore, in the sleep quality analyzing step s730, it may be determined that the user is in the deep sleep state when an average change rate of the pressure change amount of the entire section of the air pockets 110 is within a preset range A, it may be determined that the user is in the light sleep state when the average change rate of the pressure change amount of the entire section of the air pocket unit 11 is within a preset range B, and it may be determined that the user is in the wake state when the average change rate of the pressure change amount of the entire section of the air pocket unit 11 is within a preset range C.

Furthermore, in the sleep quality analyzing step s730, a score may be assigned to each of the ranges A, B, and C according to the average change rate of the pressure change amount of the entire section of the air pocket unit 11 and an average value may be calculated based on the sleep time to score the sleep quality of the user, wherein a score a may be assigned to the preset range A, a score b may be assigned to the preset range B, and a score c may be assigned to the preset range C.

As described above, in the air mattress system and the controlling method according to the embodiment of the present invention, pressure adjustment of the mattress is possible for each part of a user's body.

Furthermore, in the air mattress system and the controlling method, pressure adjustment of the mattress is possible depending on body condition and health condition of a user.

Furthermore, in the air mattress system and the controlling method, an upper portion of the air pocket is protected such that the air pocket can be prevented from being depressed due to the weight of a user.

Furthermore, the air mattress interlocks with the user terminal such that a user can control the air mattress.

Furthermore, analyzing of a sleep pattern and sleep quality of a user is possible.

DETAILED DESCRIPTION

Hereinafter, exemplary embodiments of the present invention will be described in detail with reference to the accompanying drawings. It should be noted that the embodiments of the present invention are disclosed only for illustrative purposes and should not be construed as limiting the present invention.

In the following description of the present invention, detailed descriptions of known functions and components incorporated herein will be omitted when it may make the subject matter of the present invention unclear. Furthermore, technical terms, as will be mentioned hereinafter, are terms defined in consideration of their function in the present invention, which may be varied according to the intention of a user, practice, or the like, so that the terms should be defined based on the contents of this specification.

The technical sprit of the present invention is defined by the accompanying claims, and the following embodiments are presented for those skilled in the art to be able to more clearly understand the spirit of the present invention.

Figure 1:
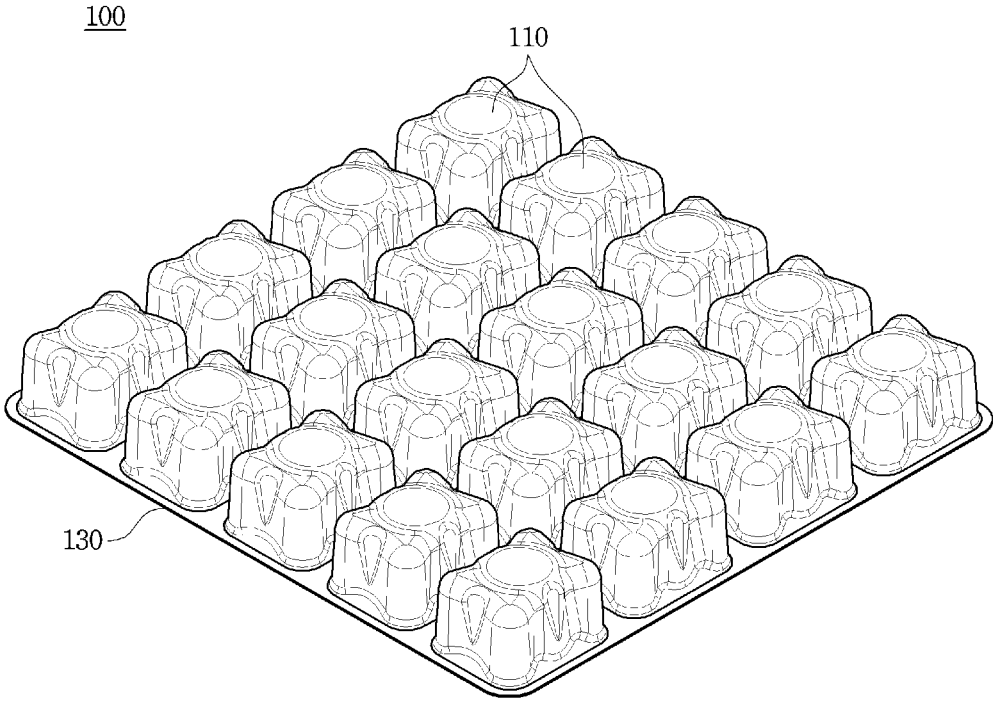
FIG. 1 is a perspective view showing an air pocket module according to an embodiment of the present invention.
Figure 2:
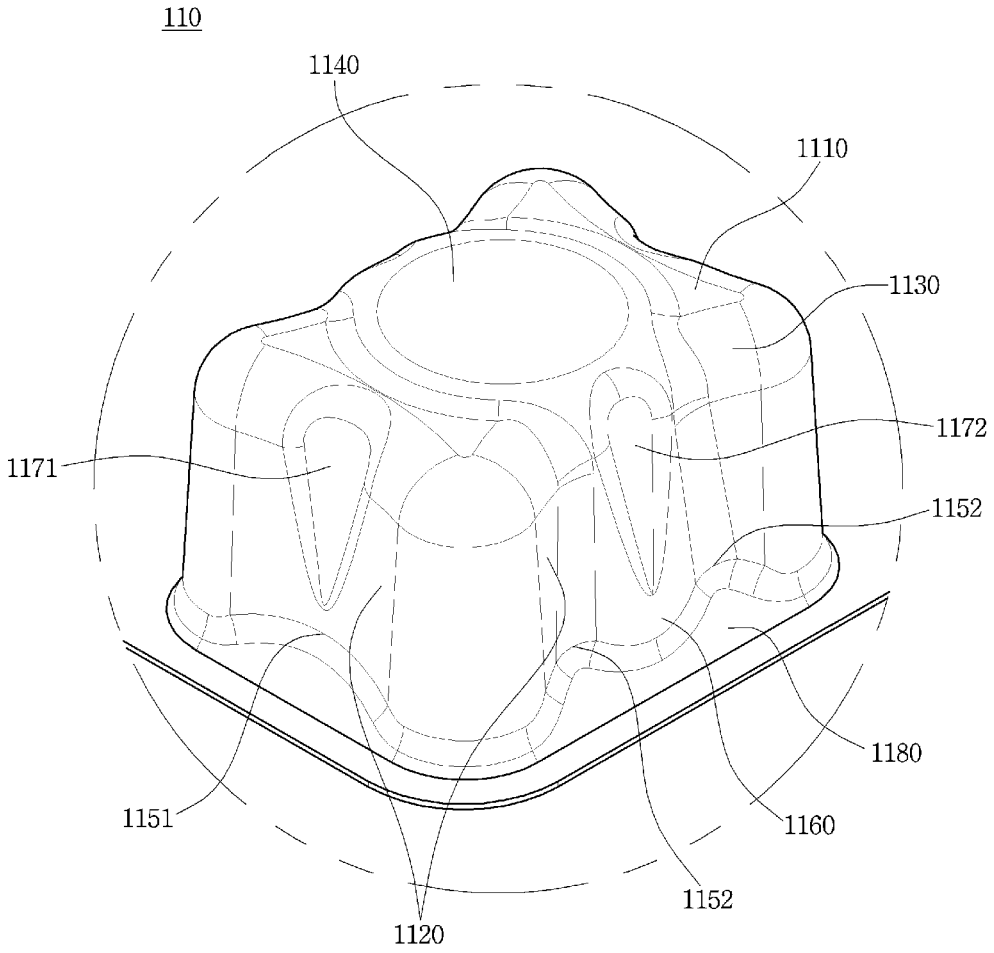
FIG. 2 is a perspective view showing an air pocket according to FIG. 1.
Figure 3:
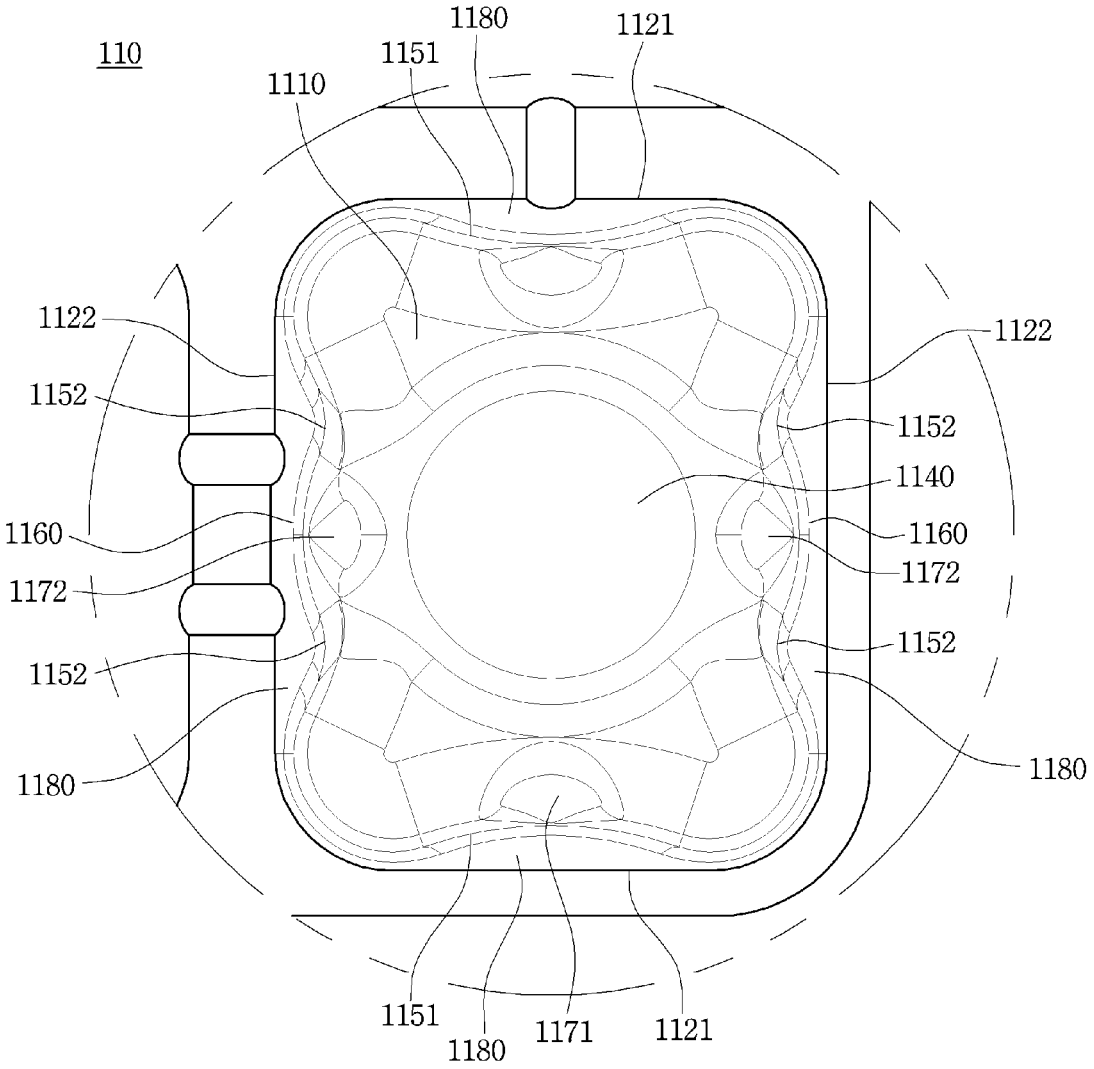
FIG. 3 is a plan view showing the air pocket according to FIG. 2.

FIG. 1 is a perspective view showing an air pocket module according to an embodiment of the present invention, FIG. 2 is a perspective view showing an air pocket according to FIG. 1, and FIG. 3 is a plan view showing the air pocket according to FIG. 2.

Referring to FIGS. 1 to 3, an air pocket module 100 is inserted into an air mattress 10 on which a user sits or lies down. Specifically, the air pocket module is used for an air mattress 10 for a bed.

The air pocket module 100 includes multiple air pockets 110 and a bottom plate 130.

Each of the air pockets 110 has a hollow portion formed therein and is configured to inflate due to air inflow or deflate due to air outflow. The air pocket 110 includes multiple surfaces.

Herein, referring to FIGS. 2 and 3, the air pocket 110 includes a top surface portion 1110, a side surface portion 1120, a first connection portion 1130, a contact portion 1140, a first inflation portion 1151, a second inflation portion 1152, a first reinforcing portion 1171, a second reinforcing portion 1172, and a second connection portion 1180.

The top surface portion 1110 forms a top surface of the air pocket 110. The top surface portion 1110 is a portion that supports a user when a user lies on the air mattress 10 and may be a portion that directly receives a load of a user. The top surface portion 1110 is depressed due to the load of a user.

The side surface portion 1120 is connected with the top surface portion 1110 to form a side surface of the air pocket 110.

In the present embodiment, the side surface portion 1120 is comprised of a total of four surfaces, and the top surface portion 1110 has a rectangular shape without being limited thereto. However, the side surface portion 1120 may include five side surfaces, and the top surface portion 1110 may have a pentagonal shape or various other shapes.

The side surface portion 1120 includes a first side surface 1121 and a second side surface 1122. Specifically, the side surface portion 1120 is comprised of four surfaces, and two facing surfaces of the four surfaces are referred to as first side surfaces 1121, and another two facing surfaces are referred to as second side surfaces 1122.

The first connection portion 1130 is formed at an edge portion where the top surface portion 1110 and the side surface portion 1120 are connected to each other to connect the top surface portion 1110 and the side surface portion 1120 to each other. In other words, the first connection portion 1130 is formed at the edge portion where the top surface portion 1110 and the side surface portion 1120 are connected to each other. The first connection portion 1130 is inclined from the top surface portion 1110 toward the side surface portion 1120.

The inclined first connection portion 1130 disperses the load of a user applied to the top surface portion 1110 and prevents deformation or depression of the top surface portion 1110 pressed by the load of a user. Specifically, the top surface portion 1110, which receives the load of a user, is pressed toward the bottom plate 130, that is, inwardly of the air pocket 110 due to the load of a user. Herein, in a case where the top surface portion 1110 and the side surface portion 1120 are directly vertically connected to each other, when the top surface portion 1110 is pressed inwardly of the air pocket 110 due to the load, a height difference occurs at the edge portion where the top surface portion 1110 and the side surface portion 1120 are connected to each other. When such a height difference occurs repeatedly, the edge portion may be easily depressed and the air pocket 110 may be broken. To prevent this, the first connection portion 1130 is formed to have a predetermined inclination. Even when the top surface portion 1110 receives the load, the height difference is reduced due to the inclination of the first connection portion 1130. Thus, the top surface portion 1110 and the side surface portion 1120 can be prevented from being depressed or broken due to a load.

The contact portion 1140 is a portion that protrudes upwards from a center of the top surface portion 1110 to support a user. In other words, the contact portion 1140 protrudes upwards from the top surface portion 1110 by a predetermined height difference therebetween. Thus, pressure applied to the top surface portion 1110 due to the load of a user is dispersed whereby the top surface portion 1110 can be protected from depression or deformation. Herein, the predetermined height difference may indicate a degree that a user does not feel discomfort when lying on the air mattress 10.

Specifically, in order to prevent the top surface portion 1110 directly receiving the load from being depressed, the contact portion 1140 protrudes from the center of the top surface portion 1110. Thus, when a user sits down or lies on the air mattress 10, the load of a user is applied firstly to the contact portion 1140. The load of a user is applied firstly to the contact portion 1140 and is then applied to the top surface portion 1110. In addition, since the contact portion 1140 protrudes, the top surface portion 1110 is directly depressed by the load of a user. Thus, when a user sits down or lies on the air mattress, the contact portion 1140 can protect the top surface portion 1110 against the load of a user that is applied to the air pocket 110.

The first inflation portion 1151 is included in the first side surface 1121. The first inflation portion 1151 is concavely formed toward the hollow portion such that when the air pockets 110 inflate, the side surface portions 1120 of each of the multiple air pockets 110 and an adjacent air pocket are prevented from coming into contact with each other.

The second inflation portion 1152 is included in the second side surface 1122. The second inflation portion 1152 is concavely formed toward the hollow portion such that when the air pockets 110 inflate, the side surface portions 1120 of each of the multiple air pockets 110 and an adjacent air pocket are prevented from coming into contact with each other. Furthermore, multiple second inflation portions 1152 are formed on each of the second side surfaces 1122.

Specifically, when air is supplied into the air pockets 110, the air pockets 110 inflate. When adjacent air pockets 110 inflate and come into contact with each other, a desired pressure of each air pocket 110 is inhibited from being formed. To prevent this, the first inflation portion 1151 and the second inflation portion 1152 are formed on the side surface portion 1120 to be concavely formed toward the hollow portion of the air pocket 110 at a predetermined depth.

The support portion 1160 is included in the second side surface 1122. The support portion 1160 protrudes outwardly of the air pocket 110 at a position between the multiple second inflation portions 1152 formed on each of the second side surfaces 1122. In other words, the support portion 1160 is formed between the two second inflation portions 1152.

The support portion 1160 has an upper end connected with the contact portion 1140 to improve supportability of the contact portion 1140.

The first reinforcing portion 1171 is included in the first side surface 1121. The first reinforcing portion 1171 is inclined inwardly from the first connection portion 1130 toward a lower end of the first side surface 1121. In addition, the first reinforcing portion 1171 is configured such that a width thereof gradually decreases from the first connection portion 1130 to a lower portion of the first side surface 1121.

The second reinforcing portion 1172 is included in the second side surface 1122. The second reinforcing portion 1172 is inclined inwardly from the first connection portion 1130 toward a lower end of the support portion 1160. The second reinforcing portion 1172 is configured such that a width thereof gradually decreases from the first connection portion 1130 to a lower portion of the support portion 1160.

The first reinforcing portion 1171 and the second reinforcing portion 1172 prevent the air pocket 110 from collapsing or being abnormally depressed as stress is concentrated on the edge portion (i.e., the first connection portion 1130) where the top surface portion 1110 and the side surface portion 1120 are connected to each other due to the load of a user applied thereto. In other words, the first reinforcing portion 1171 and the second reinforcing portion 1172 prevent deformation of the top surface portion 1110 from the load applied to the top surface portion 1110, thereby improving strength of the air pocket 110.

The first reinforcing portion 1171 and the second reinforcing portion 1172 are formed in a groove shape such that widths thereof gradually decrease from the first connection portion 1130 to a lower portion of the side surface portion 1120. A reinforcing portion 1170 is formed in a protrusion shape, but it is preferable that the reinforcing portion 1170 is formed in a groove shape because the protrusion shape may cause user discomfort.

The second connection portion 1180 is connected to a lower portion of the air pocket 110 and the bottom plate 130.

The second connection portion 1180 is formed to be inclined outwardly from a peripheral end of the air pocket 110 toward the bottom plate 130.

The bottom plate 130 is coupled to lower sides of the multiple air pockets 110 to block hollow portions of the air pockets 110. The bottom plate 130 may have a plate shape. The bottom plate 130 is provided with a nozzle 131 (see FIG. 6) through which air is supplied and discharged to and from the air pockets 110. A detailed description of the nozzle 131 will be given later with reference to FIG. 6.

Figure 4:
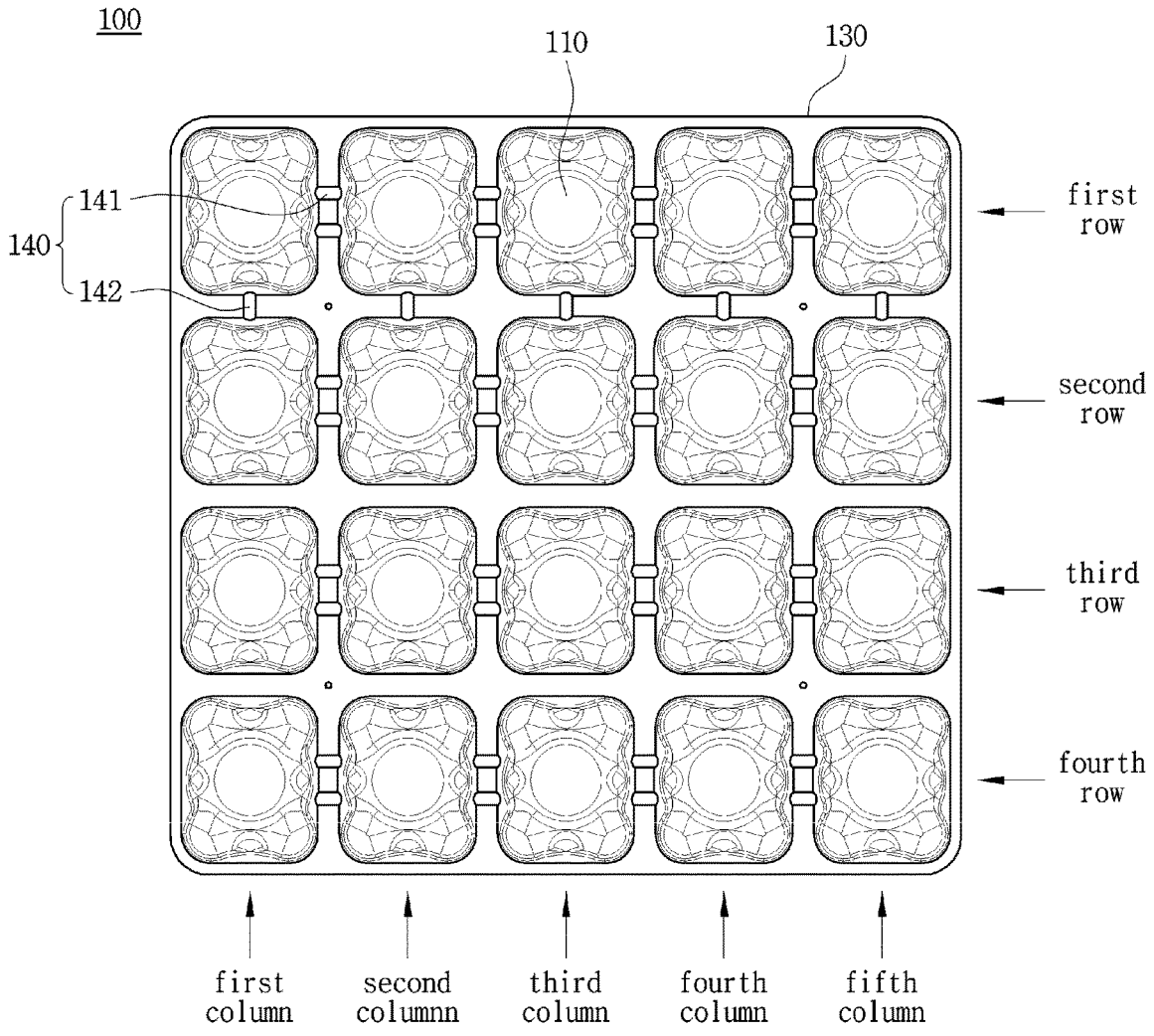
FIG. 4 is a plan view showing the air pocket module according to FIG. 1.

FIG. 4 is a plan view showing an air pocket module according to FIG. 1.

Referring to FIG. 4, the air pocket module 100 includes the multiple air pockets 110. Specifically, the multiple air pockets 110 are arranged in each of horizontal and vertical directions to form multiple rows and multiple columns, thereby forming one air pocket module 100.

In the present embodiment, the air pocket module 100 including the air pockets 110 arranged in four rows×five columns will be described as an example.

The air pocket module 100 includes a flow passage 140 communicating with the multiple air pockets 110. Specifically, the flow passage 140 includes a first flow passage 141 and a second flow passage 142.

The first flow passage 141 allows adjacent air pockets 110 in each row to communicate with each other. In other words, the first flow passage 141 allows adjacent air pockets 110 arranged in the horizontal direction to communicate with each other. At least one first flow passage 141 is provided between adjacent air pockets 110. It is preferable that two first flow passages 141 are provided between adjacent air pockets 110.

The second flow passage 142 allows adjacent air pockets 110 in each column to communicate with each other. In other words, the second flow passage 142 allows adjacent air pockets 110 arranged in the vertical direction to communicate with each other.

The first flow passage 141 is provided in each of a first row, a second row, a third row, and a fourth row. The second flow passage 142 is provided between the first row and the second row to allow the air pockets 110 in the first row and the second row to communicate with each other. In other words, the first row, the second row, the third row, and the fourth row of the air pocket module 100 are configured such that the air pockets 110 arranged in each row are allowed to communicate with each other by the first flow passage 141. Furthermore, the second flow passage 142 is provided between the first row and the second row to allow the first row and the second row to communicate with each other.

Figure 5:
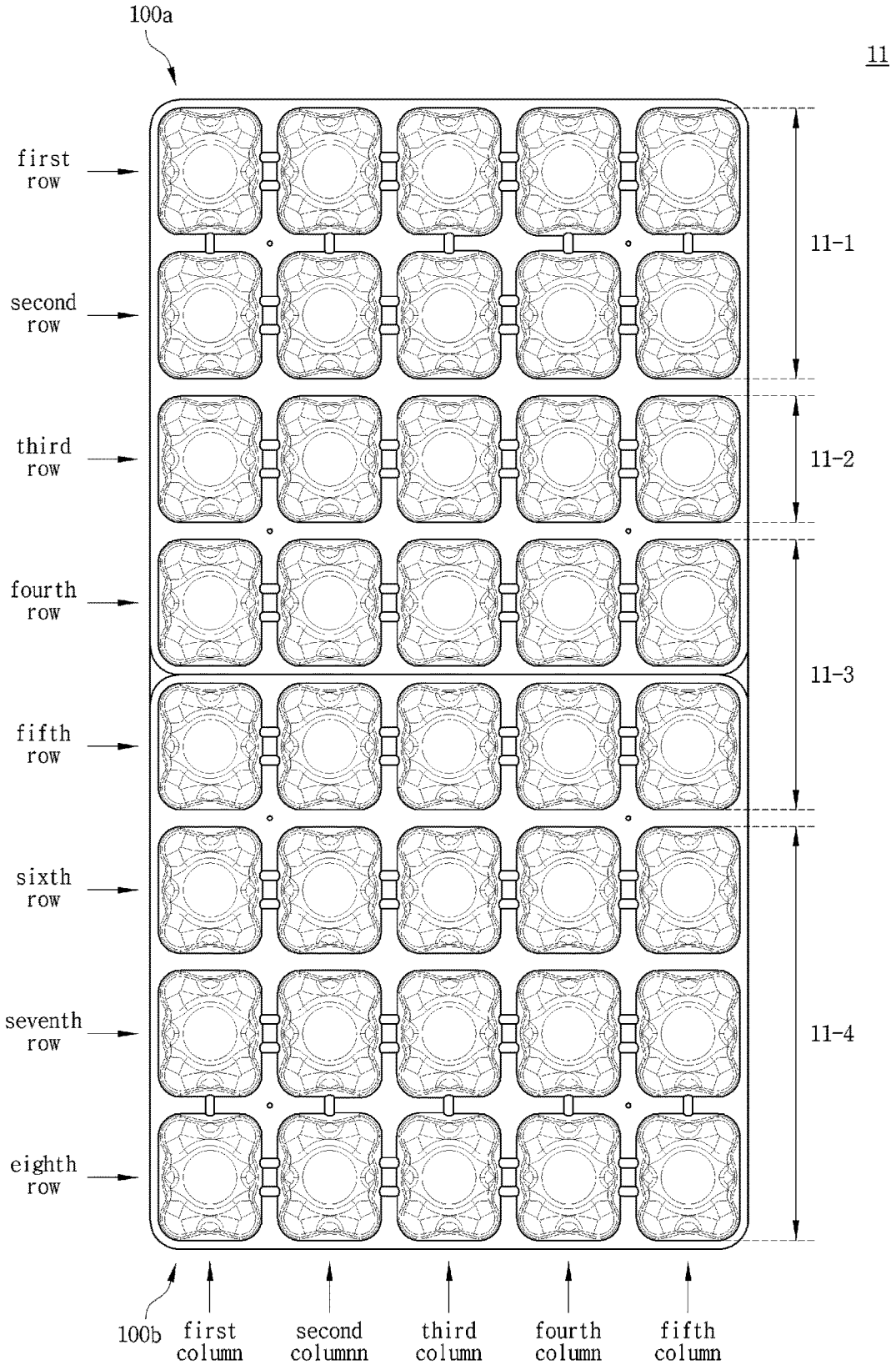
FIG. 5 is a plan view showing an air pocket unit according to the embodiment of the present invention.

FIG. 5 is a plan view showing an air pocket unit according to the embodiment of the present invention.

Referring to FIG. 5, the air mattress 10 includes an air pocket unit 11.

The air pocket unit 11 includes at least one air pocket module 100. Specifically, the air pocket unit 11 includes a pair of air pocket modules 100.

The pair of air pocket modules 100 includes a first air pocket module 100*a* and a second air pocket module 100*b*. The first air pocket module 100*a* and the second air pocket module 100*b* are disposed such that row arrangements of the air pockets 110 of the first and second air pocket modules are symmetrical with each other.

Specifically, the first air pocket module 100*a* is disposed. Then, the second air pocket module 100*b* is disposed in contact with the first air pocket module 100*a* such that the row arrangement thereof is symmetrical with the row arrangement of the first air pocket module 100*a*.

Referring to the air pocket unit 11 in which the first air pocket module 100*a* and the second air pocket module 100*b* are in contact with each other, a first row and a second row of the first air pocket module 100*a* are allowed to communicate with each other by the second flow passage 142, while a third row and a fourth row of the second air pocket module 100*b* are allowed to communicate with each other by the second flow passage 142.

Hereinafter, with reference to FIG. 5, the air pocket unit 11 including the air pockets 110 arranged in eight rows×five columns will be described as an example.

The air pocket unit 11 is configured such that the multiple air pockets 110 in each of the first to eighth rows are allowed to communicate with each other by the first flow passage 141. In addition, the first row and the second row are allowed to communicate with each other by the second flow passage 142, and the seventh row and the eighth row are allowed to communicate with each other by the second flow passage 142.

The air pocket unit 11 composed of eight rows×five columns is divided into multiple sections. Herein, the air pocket unit is divided into the multiple sections depending on a position where the body part of a user is located.

As an example, the air pocket unit 11 is divided into a first section 11-1, a second section 11-2, a third section 11-3, and a fourth section 11-4.

The first section 11-1 is where a user's shoulder is located and is formed by at least one row of the air pocket unit 11.

The second section 11-2 is where a user's waist is located and is formed by at least one row of the air pocket unit 11.

The third section 11-3 is where user's buttocks are located and is formed by at least one row of the air pocket unit 11.

The fourth section 11-4 is where user's thighs and knees are located and is formed by multiple rows of the air pocket unit 11.

In the present embodiment, as an example, the first section 11-1 is formed by two rows, the second section 11-2 is formed by one row, the third section 11-3 is formed by two rows, and the fourth section 11-4 is formed by three rows.

A fifth section (not shown) may be where user's head or user's feet are located. The section where the user's head is located may be provided as a general mat without having the air pockets 110 being arranged. In general, the section where the user's head is located may not be provided with the air pockets 110 because a user may use a pillow, or a pressure change of the air pockets may not be required. Likewise, the section where the user's feet are located may also not have the air pockets 110 being arranged. However, the present invention is not limited thereto, and the air pockets 110 may be arranged in the section where the user's head or user's feet are located, and the pressure of the air pockets may be adjusted.

In addition, an interval between each row of the air pockets 110 arranged in the air pocket unit 11 may be 150 mm. This is an interval such that the air pockets 110 may not interfere with each other when adjacent ones of the air pockets 110 inflate. Furthermore, an interval between each column may be 125 mm without being limited thereto.

Figure 6:
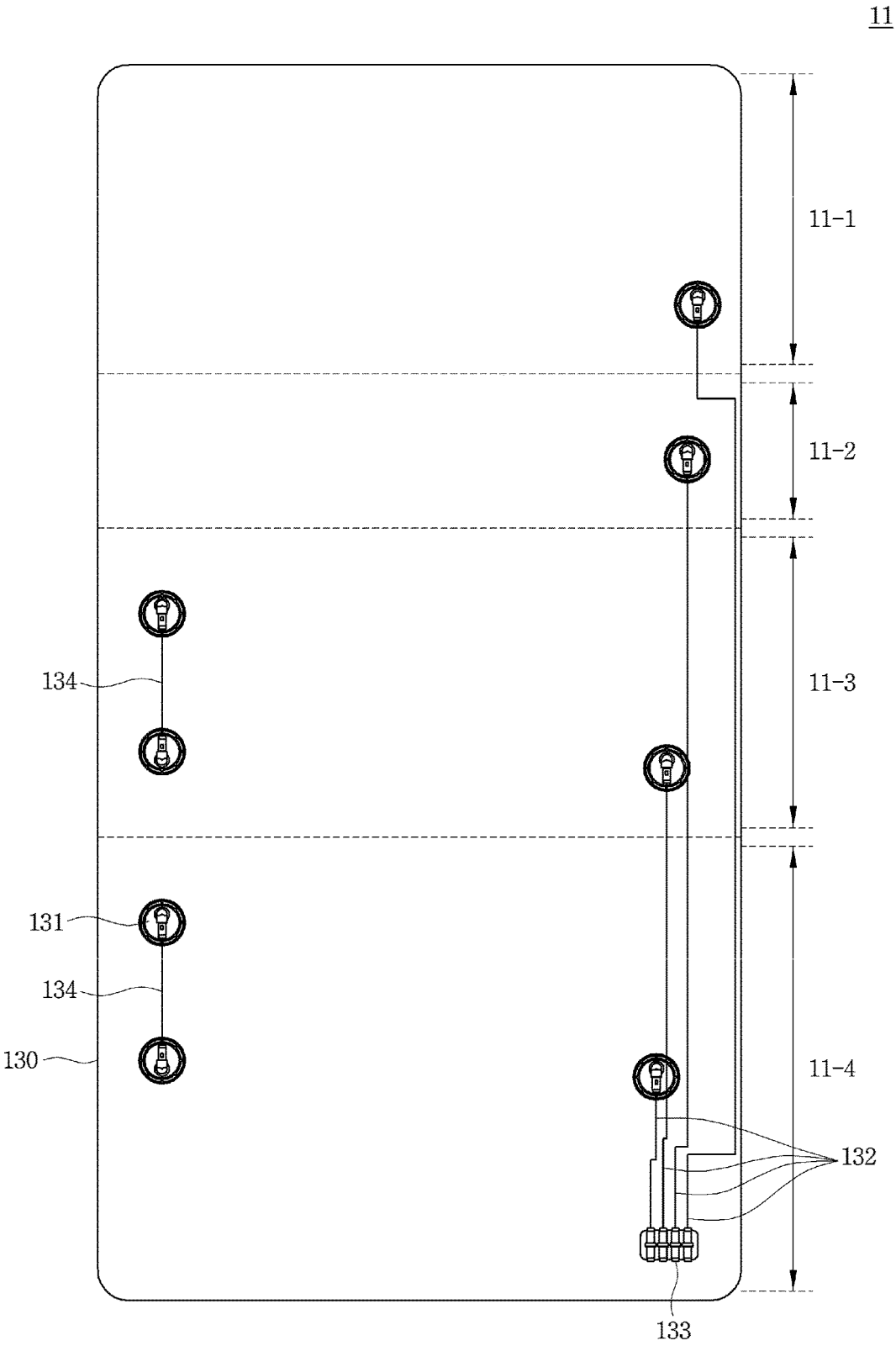
FIG. 6 is a bottom view showing the air pocket unit according to FIG. 5.

FIG. 6 is a view showing the bottom plate of the air pocket unit according to FIG. 5.

Referring to FIG. 6, the bottom plate 130 is provided with the nozzle 131, a supply line 132, a valve 133, and a section connection line 134.

The nozzle 131 may be an inlet for allowing air to be supplied to and discharged from the air pockets 110. At least one nozzle 131 is provided in each of the first section 11-1, the second section 11-2, the third section 11-3, and the fourth section 11-4. Since the nozzle 131 is provided in each section, the pressure of the air pockets 110 is adjusted for each section of the air pocket unit 11.

However, in the present embodiment, one nozzle 131 communicating with the supply line 132 is provided for each section, but the present invention is not limited thereto. For example, multiple nozzles 131 may be provided in a section where pressure change of the air pockets 110 is large. In the third section 11-3 where the user's buttocks are located and the fourth section 11-4 where the user's thighs and knees are located, there is a large pressure change due to a large body load. Accordingly, the multiple nozzles 131 may be provided in the third section 11-3 and the fourth section 11-4. For example, two nozzles 131 are arranged in the first section 11-1, one nozzle 131 is arranged in the second section 11-2, three nozzles 131 are arranged in the third section 11-3, and two nozzles 131 are arranged in the fourth section 11-4. Furthermore, the nozzle 131 may be arranged at each of opposite sides of the bottom plate 130.

In addition, the nozzle 131 communicates with the section connection line 134 as well as the supply line 132. For example, multiple nozzles 131 are provided in the third section 11-3 to allow the fourth row and the fifth row, which do not communicate with each other, to communicate with each other. Likewise, multiple nozzles 131 are provided in each of the sixth row and the seventh row to allow the sixth row and the seventh row, which do not communicate with each other, to communicate with each other.

The supply line 132 connects the nozzle 131 and the valve 133 with each other. Multiple supply lines 132 communicate with multiple nozzles 131, respectively. Each of the supply lines 132 is configured such that air supply and air discharge to and from the air pockets 110 are switched by the valve 133.

The valve 133 adjusts air supply from an air pump 15 (see FIG. 9) to the air pockets 110 and air discharge from the air pockets 110. The valve 133 may be a solenoid valve. However, the present invention is not limited thereto and may include various types of valves 133.

The section connection line 134 allows a row of the third section 11-3 and a row of the fourth section 11-4, which do not communicate with each other, by the second flow passage 142, to communicate with each other.

Specifically, the section connection line 134 allows the fourth row and the fifth row of the third section 11-3, which do not communicate with each other, to communicate with each other. In other words, the section connection line 134 is connected to the nozzle 131 provided in each of the fourth row and the fifth row so as to allow the fourth row and the fifth row of the air pockets 110 to communicate with each other.

Likewise, the section connection line 134 allows the sixth row and the seventh row of the fourth section 11-4, which do not communicate with each other, to communicate with each other. In other words, the section connection line 134 is connected to the nozzle 131 provided in each of the sixth row and the seventh row so as to allow the rows of air pockets 110 in the fourth section 11-4 to communicate with each other.

Figure 7:
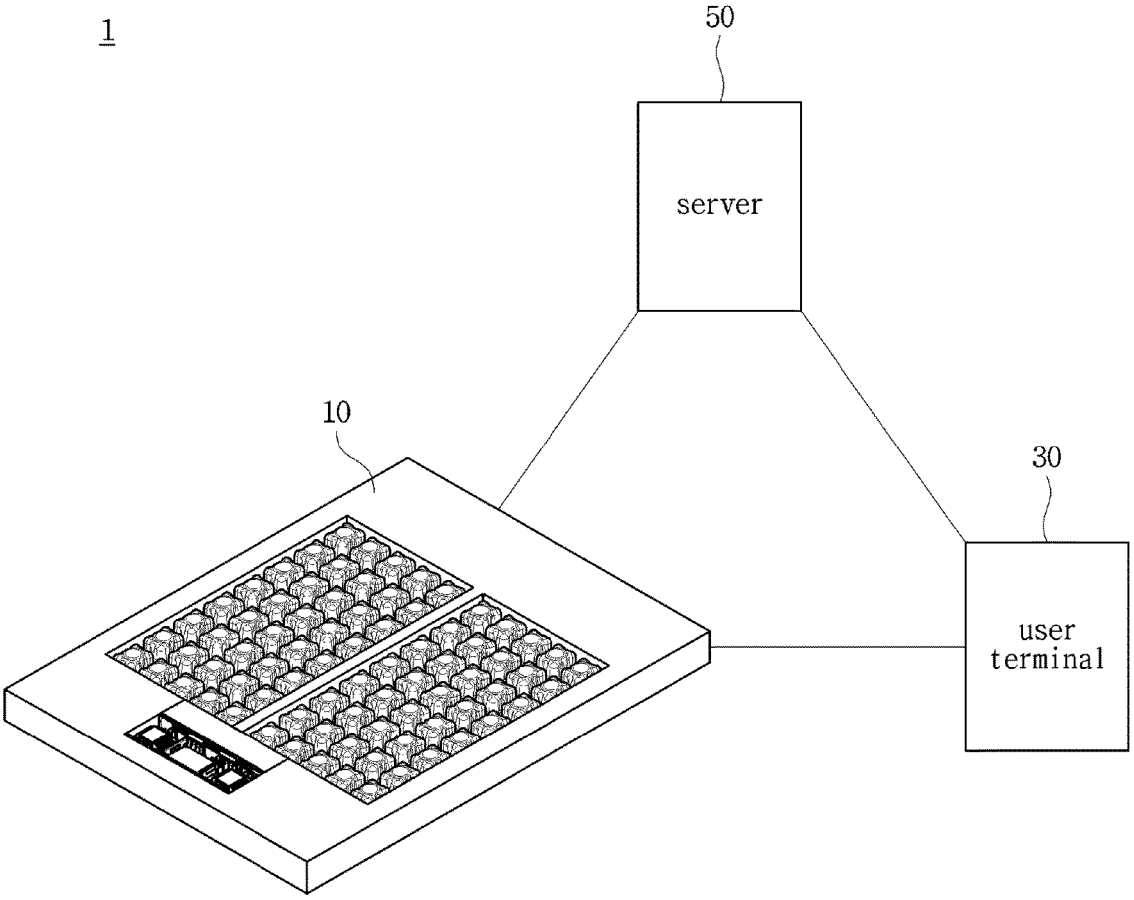
FIG. 7 is a view schematically showing an air mattress system according to the embodiment of the present invention.

FIG. 7 is a view schematically showing an air mattress system according to the embodiment of the present invention.

Referring to FIG. 7, an air mattress system 1 includes an air mattress 10, a user terminal 30, and a server 50.

The air mattress 10 includes the air pocket unit 11 described above and is capable of adjusting the pressure of the air pockets 110 of the air pocket unit 11. Specifically, the pressure of the air pockets 110 of the air mattress 10 is adjusted for each section of the multiple sections based on a set value or user information set and input by a user.

The user terminal 30 receives the set value or the user information from a user and transmits the set value or the user information to the air mattress 10. The user terminal 30 may be any one of a notebook computer, a computer, and a mobile phone.

The server 50 receives measurement data from the air mattress 10, analyzes a sleep pattern and sleep quality of a user, and transmits the analyzed sleep pattern and sleep quality to the user terminal 30.

The air mattress 10 and the server 50 will be described in detail later.

Figure 8:
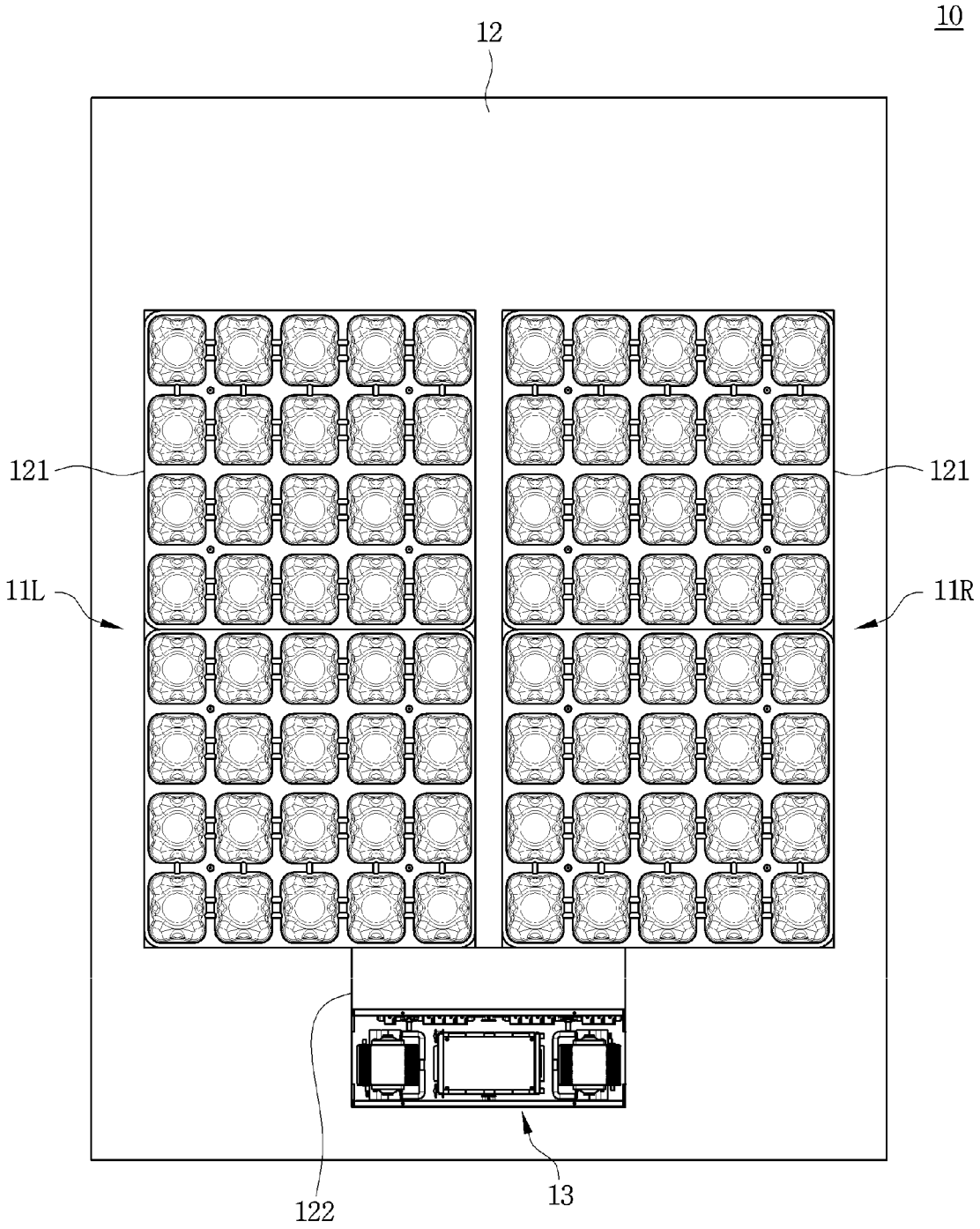
FIG. 8 is a view showing an air mattress according to the embodiment of the present invention.
Figure 9:
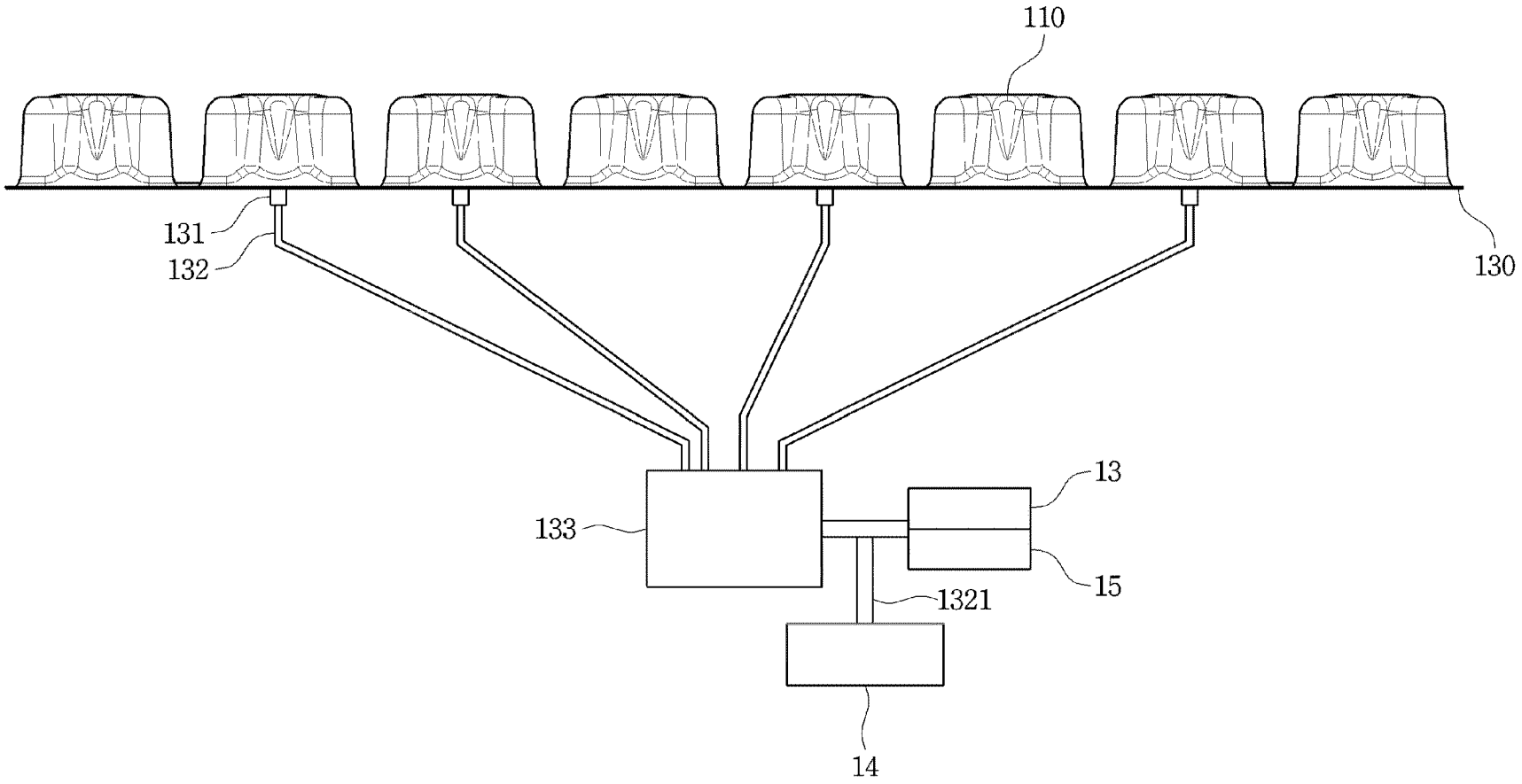
FIG. 9 is a view schematically showing the air mattress according to the embodiment of the present invention.
Figure 10:
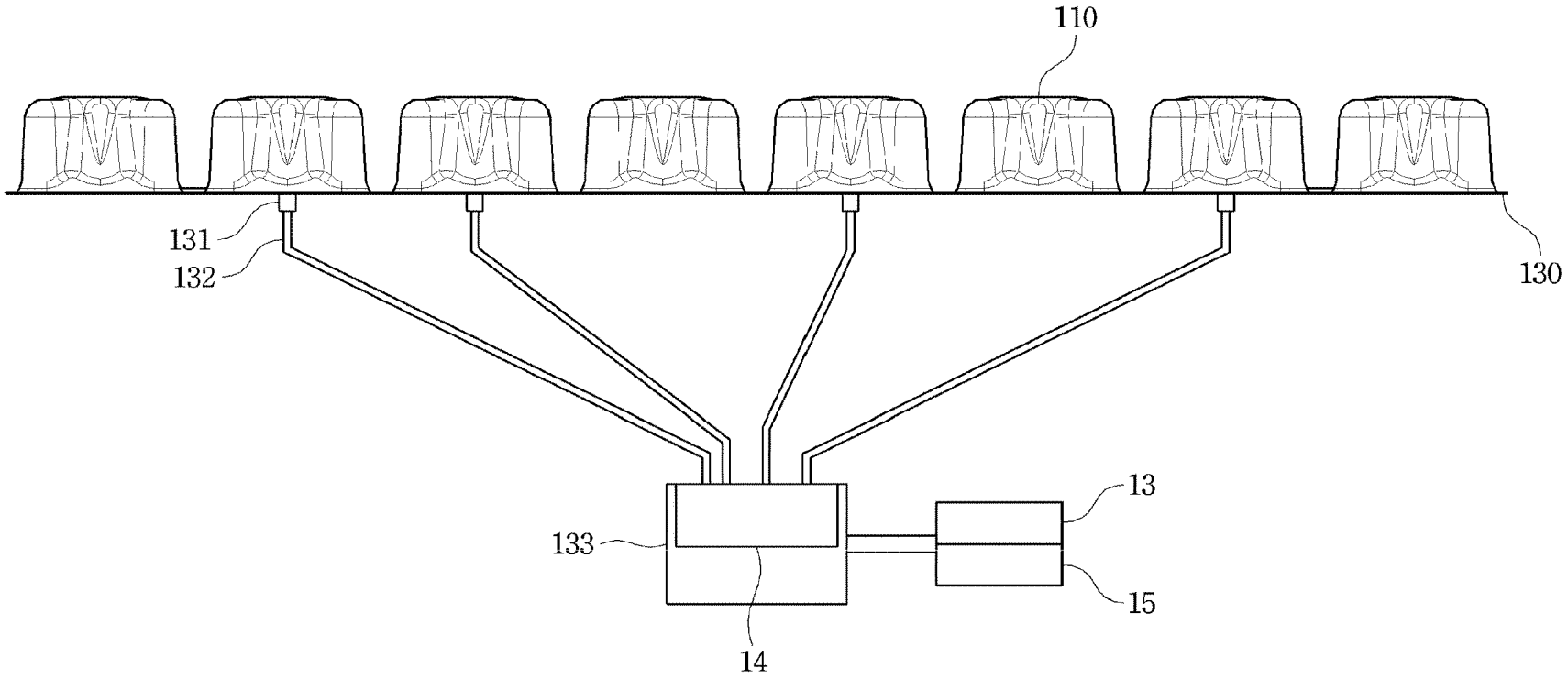
FIG. 10 is a view showing another embodiment of a pressure sensor unit of the air mattress according to FIG. 9.

FIG. 8 is a view showing an air mattress according to the embodiment of the present invention, FIG. 9 is a view schematically showing the air mattress according to the embodiment of the present invention, and FIG. 10 is a view showing another embodiment of a pressure sensor unit of the air mattress according to FIG. 9.

Referring to FIGS. 8 to 10, an air mattress 10 includes an air pocket unit 11, a body portion 12, a mattress controller 13, a pressure sensor unit 14, and an air pump 15.

At least one air pocket unit 11 is inserted into the body portion 12. In the present embodiment, two air pocket units 11 inserted into the body portion 12 are described as an example. Specifically, a first air pocket unit 11L and a second air pocket unit 11R are respectively arranged at left and right sides of the body portion 12. The first air pocket unit 11L and the second air pocket unit 11R are individually controlled by the mattress controller 13.

The body portion 12 forms the overall shape of the air mattress 10, and the air pocket unit 11 is inserted thereinto. The body portion 12 is provided with an air pocket unit fixing portion 121 where the air pocket unit 11 is inserted. In addition, the body portion is provided with a controller fixing portion 122 where the mattress controller 13 is mounted.

The mattress controller 13 is mounted at the body portion 12. The mattress controller 13 controls the air mattress 10. Specifically, the mattress controller adjusts the pressure of the air pocket unit 11. The mattress controller 13 adjusts the pressure of the multiple air pockets 110 arranged in each of the first section 11-1, the second section 11-2, the third section 11-3, and the fourth section 11-4.

In addition, the mattress controller 13 individually controls the first air pocket unit 11L and the second air pocket unit 11R respectively arranged at the left and right sides of the body portion 12.

The pressure sensor unit 14 measures the pressure of the air pocket unit 11.

The pressure sensor unit 14 measures the pressure of the air pockets 110 and possibly measures the pressure of each section of the first section 11-1, the second section 11-2, the third section 11-3, and the fourth section 11-4.

Based on the pressure measured by the pressure sensor unit 14, the mattress controller 13 controls air supply and air discharge to and from the air pockets 110 in each of the first section 11-1, the second section 11-2, the third section 11-3, and the fourth section 11-4 to adjust the pressure of the air pockets 110.

Referring to FIG. 9, one pressure sensor unit 14 is provided. In this case, the pressure sensor unit 14 is connected with a main supply line 1321 to measure the pressure of each of the supply lines 132.

Referring to FIG. 10, multiple pressure sensor units 14 are provided. The pressure sensor units 14 are disposed in the valve 133 and each of the pressure sensor units is connected to each of supply lines 132. The pressure sensor unit 14 connected to the supply line 132 measures the pressure of the air pockets 110 in each section.

Based on the pressure measured by the pressure sensor unit 14, the mattress controller 13 adjusts the pressure of the air pockets 110.

The air pump 15 supplies air to the air pockets 110 through the supply lines 132.

Figure 11:
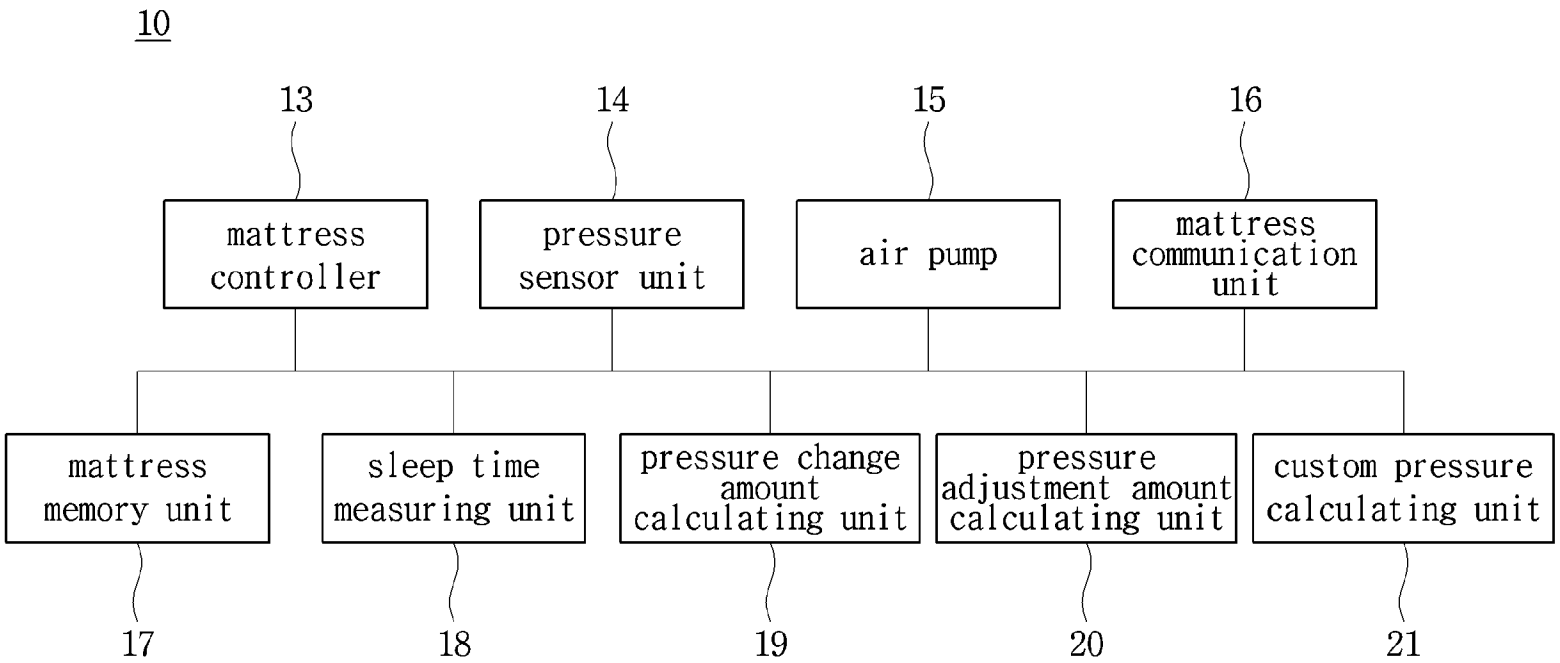
FIG. 11 is a block diagram schematically showing a configuration of the air mattress according to the embodiment of the present invention.

FIG. 11 is a block diagram schematically showing a configuration of the air mattress according to the embodiment of the present invention.

Referring to FIG. 11, the air mattress 10 includes a mattress communication unit 16, a mattress memory unit 17, a sleep time measuring unit 18, a pressure change amount calculating unit 19, a pressure adjustment amount calculating unit 20, and a custom pressure calculating unit 21.

The mattress communication unit 16 communicates with the user terminal 30 and the server 50 to transmit and receive data. The mattress communication unit 16 receives the set value or the user information from the user terminal 30. Herein, the set value may be a set value for setting the condition and environment of the air mattress 10, the set value including pressure intensity desired by a user, a sleep time, etc., and the user information may be information related to a user's body, the user information including the height, weight, clothing size, health condition, etc. of a user.

The mattress communication unit 16 is connected with a server communication unit 52 (see FIG. 12) and transmits the measurement data to the server 50. Herein, the measurement data includes the pressure measurement value measured by the air mattress 10, a pressure change amount, the sleep time, and a pressure adjustment amount for each section.

The mattress memory unit 17 stores the set value or the user information received by the mattress communication unit 16. In addition, the mattress memory unit stores the measurement data measured and calculated by the pressure sensor unit 14, the sleep time measuring unit 18, the pressure change amount calculating unit 19, and the pressure adjustment amount calculating unit 20.

The sleep time measuring unit 18 measures the sleep time based on the time that a user uses the air mattress 10. The time from a moment when a user turns on the air mattress 10 to a moment when a user turns off the air mattress 10 is measured. For example, the set time received from the user terminal 30 is measured as the sleep time.

Furthermore, the sleep time measuring unit 18 has a timer function. The sleep time measuring unit has an automatic termination function or an alarm function according to the sleep time set by a user as the set value, etc. For example, after the time set by a user, a function such as a pressure adjusting function, a pressure measuring function, etc. of the air pockets 110 of the air mattress 10 is automatically terminated.

Furthermore, the sleep time measuring unit 18 measures the time that a user uses the air mattress 10 based on pressure applied to the air pocket unit 11, even when a user does not set the sleep time. For example, the time during which the load of a user is applied to the air pocket unit 11 is measured as a use time.

The pressure change amount calculating unit 19 calculates the pressure change amount of the air pocket unit 11 while a user uses the air mattress 10. Specifically, the pressure change amount calculating unit 19 calculates the pressure change amount of the air pocket unit 11 during the sleep time based on the pressure measurement value measured in real time by the pressure sensor unit 14.

For example, the pressure change amount may be a difference between an initial pressure measurement value that is initially set by the set value or the user information and a change pressure measurement value at which the pressure of the air pockets 110 is changed. Specifically, when the pressure change amount calculating unit 19 calculates the pressure change amount at intervals of one hour, the pressure change amount calculated by the pressure change amount calculating unit 19 may be the difference between the initial pressure measurement value and the change pressure measurement value. For example, the pressure change amount at time T2 is obtained by subtracting the initial pressure measurement value from the change pressure measurement value at time T2. Likewise, the pressure change amount at time T3 is obtained by subtracting the initial pressure measurement value from the change pressure measurement value at time T3.

Alternatively, the pressure change amount may be obtained by a difference between change pressure measurement values that change at intervals of one hour. For example, the pressure change amount up to time T2, one hour after time T1, is calculated by subtracting the pressure measurement value at time T1 from the pressure measurement value at time T2.

The pressure adjustment amount calculating unit 20 calculates the pressure adjustment amount for adjusting the pressure of the air pocket unit 11 to be within an optimum air pocket pressure range according to the user based on the calculated pressure change amount. Herein, the optimum air pocket pressure range may range from a preset lower limit value of pressure to a preset upper limit value of pressure that are determined based on the set value and the user information.

In a section of the multiple sections where the pressure change amount is equal to or greater than the preset upper limit value, the pressure adjustment amount calculating unit 20 calculates the pressure adjustment amount such that the pressure of the air pockets 110 in the corresponding section is less than the preset upper limit value. In addition, in a section of the multiple sections where the pressure change amount is equal to or less than the preset lower limit value, the pressure adjustment amount calculating unit calculates the pressure adjustment amount such that the pressure of the air pockets 110 in the corresponding section is greater than the preset lower limit value.

Thus, the mattress controller 13 adjusts air in the air pockets 110 based on the pressure adjustment amount calculated by the pressure adjustment amount calculating unit 20.

Specifically, the mattress controller 13 controls to allow air of the air pockets 110 to be discharged in the section of the multiple sections where the pressure change amount is equal to or greater than the preset upper limit value, based on the pressure adjustment amount calculated by the pressure adjustment amount calculating unit 20. In addition, the mattress controller controls to allow air to be supplied to the air pockets 110 in the section of the multiple sections where the pressure change amount is equal to or less than the preset lower limit value, based on the pressure adjustment amount calculated by the pressure adjustment amount calculating unit 20.

The custom pressure calculating unit 21 measures the user's load for each section based on the initial pressure measurement value measured by the pressure sensor unit 14 when a user lies on the air mattress 10. The pressure adjustment amount according to a user is calculated based on the user information or the measured load for each section. For example, when a user lies on the mattress, it is measured which section receives a relatively large load and which section receives a relatively small load, based on the initial pressure measurement value, whereby the pressure of the air pockets 110 for each section according to the user's body is obtained. Thus, it is possible to adjust the pressure of the air pockets 110 depending on the user's body.

Figure 12:
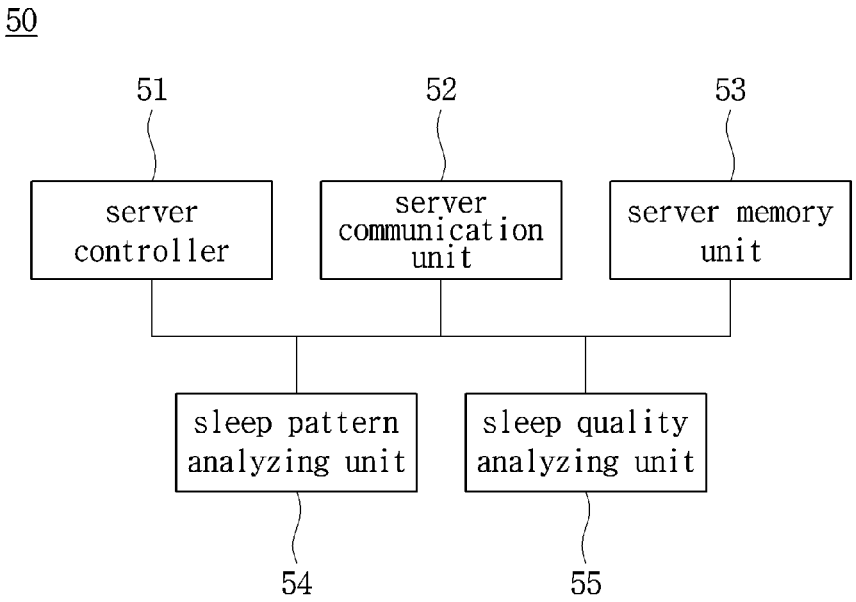
FIG. 12 is a block diagram schematically showing a configuration of a server according to the embodiment of the present invention.

FIG. 12 is a block diagram schematically showing a configuration of a server according to the embodiment of the present invention.

Referring to FIG. 12, the server 50 includes a server controller 51, a server communication unit 52, a server memory unit 53, a sleep pattern analyzing unit 54, and a sleep quality analyzing unit 55.

The server 50 receives the measurement data from the air mattress 10, analyzes the sleep pattern and the sleep quality of a user, and transmits a result of analysis to the user terminal 30.

The server controller 51 controls the server communication unit 52, the server memory unit 53, the sleep pattern analyzing unit 54, and the sleep quality analyzing unit 55 to control the server 50.

The server communication unit 52 communicates with the air mattress 10 and the user terminal 30. Specifically, the server communication unit receives the measurement data from the air mattress 10 and transmits information of the analyzed sleep pattern and sleep quality to the user terminal 30.

The server memory unit 53 stores the measurement data, the sleep pattern information, and the sleep quality information for each user.

The sleep pattern analyzing unit 54 analyzes the sleep time and the sleep posture based on the measurement data. Specifically, the sleep pattern analyzing unit analyzes the sleep time by calculating a daily sleep time, a weekly average sleep time, and a monthly average sleep time based on sleep time data received from the sleep time measuring unit 18.

In addition, the sleep pattern analyzing unit 54 determines and analyzes the sleep posture of a user by measuring, by the pressure sensor unit 14, the pressure in each section where the pressure increases. For example, it is determined that a user lies on his or her side when the pressure change amount of the first section 11-1 is greater than the pressure change amount of other sections. When a user lies on his or her side, a relatively large load is applied to the first section 11-1 where the user's shoulder is located, and a relatively small load is applied to the second section 11-2 where the user's waist is located.

Furthermore, it is determined that a user lies on his or her back when the pressure change amount of the third section 11-3 is greater than the pressure change amount of other sections. When the load is entirely applied to the third section 11-3 where the user's buttocks are located, it is determined that a user lies on his or her back.

In addition, the load is concentrated in a specific section such as when the load is concentrated in the first section 11-1 and the second section 11-2, or when the load is concentrated in the second section 11-2 and the third section 11-3, it is determined that a user curls up on his or her side in a fetal posture.

As described above, the posture of a user is ascertained based on load distribution for each section. Thus, the sleep pattern analyzing unit 54 analyzes a main sleep posture taken by a user during the sleep time, and time per sleep posture.

Specifically, during the user's sleep time, the user's sleep posture including a side posture, a back posture, a stomach posture, a fetal posture, etc. is ascertained due to a pressure change of the air pockets 110. In addition, a maintaining time of each posture is ascertained to analyze the main sleep posture mainly taken by a user during the sleep time, and the time per sleep posture.

The sleep quality analyzing unit 55 divides a sleep state of a user into a deep sleep state, a light sleep state, and a wake state, and determines and analyzes the sleep state based on the measurement data, thereby scoring the sleep quality.

The sleep quality analyzing unit 55 determines that a user is in the deep sleep state when an average change rate of the pressure change amount of the entire section of the air pockets 110 is within a preset range A. Furthermore, the sleep quality analyzing unit determines that a user is in the light sleep state when the average change rate of the pressure change amount of the entire section of the air pocket unit 11 is within a preset range B. Furthermore, the sleep quality analyzing unit determines that a user is in the wake state when the average change rate of the pressure change amount of the entire section of the air pocket unit 11 is within a preset range C.

In other words, the sleep quality analyzing unit assigns a score to each of the ranges A, B, and C according to the average change rate of the pressure change amount of the entire section of the air pocket unit 11, and calculates an average value based on the sleep time to score the sleep quality of a user. Specifically, a score a is assigned to the preset range A, a score b is assigned to the preset range B, and a score c is assigned to the preset range C.

For example, the sleep quality analyzing unit 55 determines the deep sleep state when the average change rate of pressure is equal to or less than 10%, determines the light sleep state when the average change rate of pressure is greater than 10% and equal to or less than 30%, and determines the wake state when the average change rate of pressure is greater than 30%. In the case of the deep sleep state ten scores are assigned. In the case of the light sleep state, five scores are assigned. In the case of the wake state, one score is assigned. In this manner, a score is assigned to each state, the sum of the score of each state according to time is calculated, and the sum is divided by a total time, thus calculating a sleep quality score.

Figures 13A, 13B:
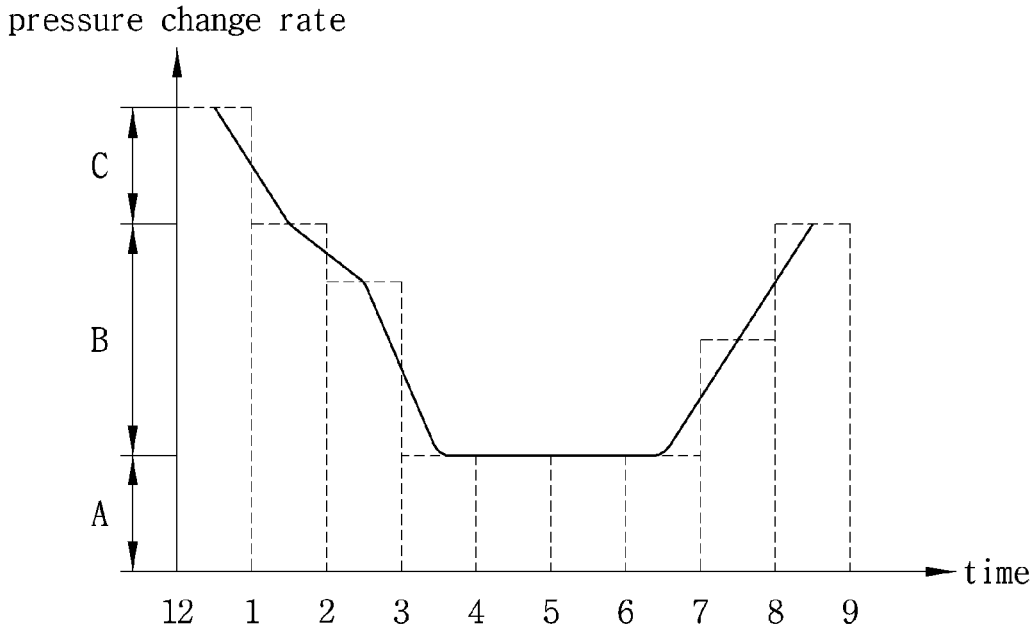
FIG. 13*a* is a graph showing a pressure change rate as a function of time in order to score sleep quality according to the embodiment of the present invention.
FIG. 13*b* is a view showing a formula for scoring the sleep quality according to FIG. 13*a*.

FIGS. 13*a* and 13*b* show a process of scoring the sleep quality according to the embodiment of the present invention, FIG. 13*a* is a graph showing a pressure change rate as a function of time in order to score the sleep quality according to the embodiment of the present invention, and FIG. 13*b* is a view showing a formula for scoring the sleep quality according to FIG. 13*a*.

Referring to FIGS. 13*a* and 13*b*, the sleep quality analyzing unit 55 represents the average change rate of the pressure change amount of the entire section of the air pocket unit 11 measured by a pressure change rate measuring unit 19 over time. For example, the average change rate of pressure is represented at intervals of one hour.

FIG. 13*a* shows a graph showing the pressure change rate of the air pocket unit 11 measured during the sleep time, for example, from twelve a.m. to nine a.m., as an example of the user's sleep time.

It is seen that the average change rate of pressure from a twelve o'clock a user started sleeping to two o'clock is greater than the preset range C, so that it is determined that a user is in the wake state.

It is seen that the average change rate of pressure between two o'clock and three o'clock is within the preset range B, so that it is determined that a user is in the light sleep state.

Thereafter, it is shown that the average change rate of pressure between three o'clock and seven o'clock is equal to or less than the preset range A, so that it is determined that a user is in the deep sleep state.

It is seen that the average change rate of pressure between seven o'clock and nine o'clock gradually increases from the preset ranges B to C, so that it is determined that a user gradually wakes up from sleeping.

In summary, a time zone where the average change rate of pressure is measured as the preset range A is from three to seven o'clock, which indicates four hours in a total time. A time zone where the average change rate of pressure is measured as the preset range B is from one to three o'clock and from seven to eight o'clock, which indicates three hours in a total time. A time zone where the average change rate of pressure is measured as the preset range C is from twelve to one o'clock and from eight to nine o'clock, which indicates two hours in a total time.

The scores a, b, and c are respectively assigned to the preset ranges A, B, and C, thus scoring the sleep quality. In the case of the deep sleep state, a high score is assigned, in the case of the wake state, a low score is assigned, and in the case of the light sleep state, a medium score is assigned.

FIG. 13*b* shows that the sleep quality is scored using the scores assigned to the preset ranges.

Referring to FIG. 13*b*, an average score of the sleep quality is obtained by multiplying the scores corresponding to each sleep state and the time during which each sleep state is maintained, and a result of multiplication is divided by the total time.

For example, the score a of the deep sleep state measured within the preset range A is multiplied by four hours of a deep sleep time, the score b of the deep sleep state measured within the preset range B is multiplied by three hours of the deep sleep time, and the score c of the deep sleep state measured within the preset range c is multiplied by two hours of the deep sleep time. Thereafter, the sum of multiplication results is divided by nine hours of a total sleep time, thereby calculating the average score.

The preset range A is assigned with ten scores, the preset range B is assigned with five scores, and the preset range C is assigned with one score. In this case, referring to FIG. 13*b*, the sleep quality is scored by dividing the sum of (ten×five), (five×three), and (one×two) by nine that is the total sleep time.

Figure 14A:
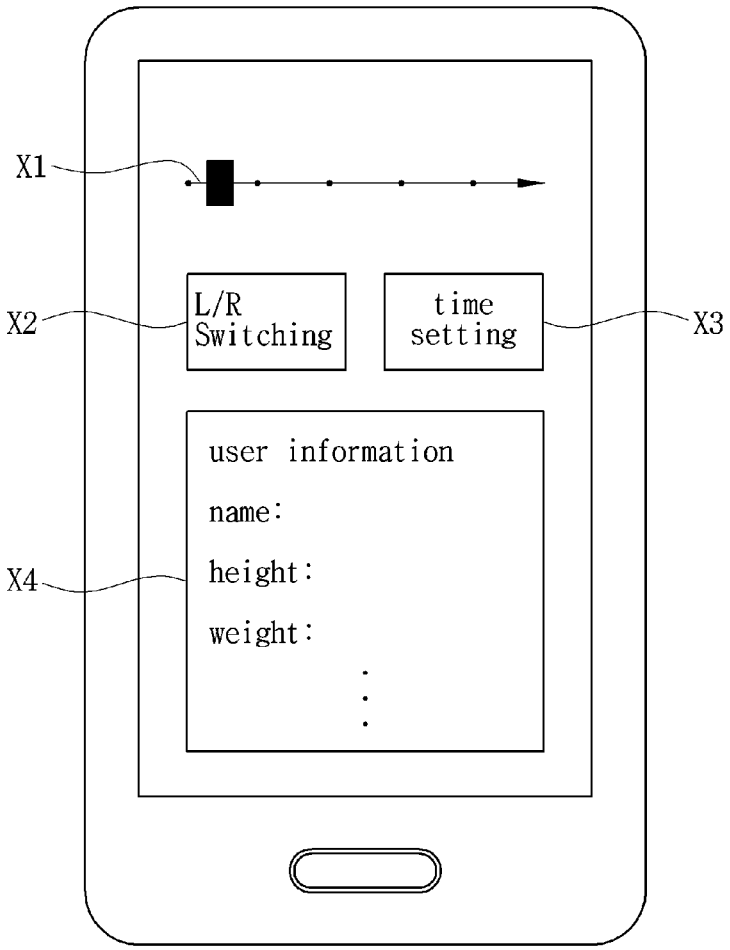
FIG. 14*a* is a view showing a setting screen of a user terminal according to the embodiment of the present invention.
Figure 14B:
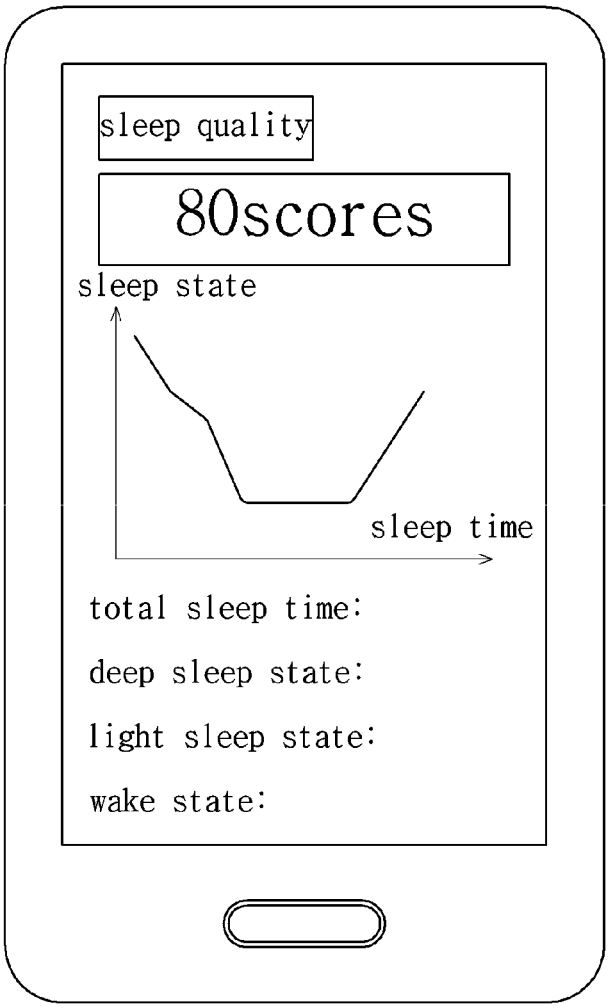
FIG. 14*b* is a view showing a sleep quality score screen of the user terminal according to the embodiment of the present invention.
Figure 14C:
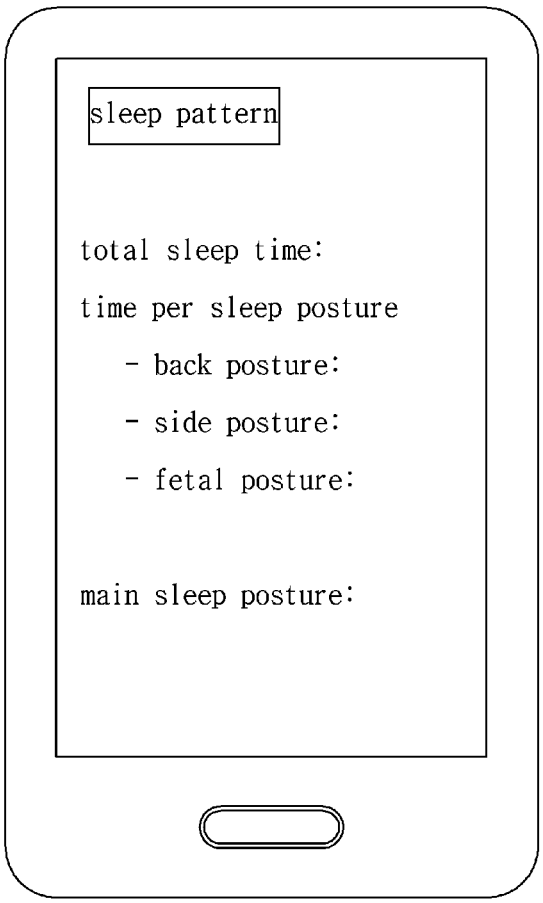
FIG. 14*c* is a view showing a sleep pattern analysis screen of the user terminal according to the embodiment of the present invention.

FIG. 14*a* is a view showing a setting screen of a user terminal according to the embodiment of the present invention, FIG. 14*b* is a view showing a sleep quality score screen of the user terminal according to the embodiment of the present invention, and FIG. 14*c* is a view showing a sleep pattern analysis screen of the user terminal according to the embodiment of the present invention.

Referring to FIG. 14*a*, a user manually adjusts the pressure of the mattress using a pressure adjustment menu x1. However, FIG. 14*a* shows that, by way of example, a user manually adjusts the pressure using the pressure adjustment menu x1, but the present invention is not limited thereto. As described above, the pressure of the mattress is automatically adjusted by configurations including the mattress controller 13, the pressure adjustment amount calculating unit 20, etc.

The setting of the first air pocket unit 11L disposed at the left side and the second air pocket unit 11R disposed at the right side is switched using an L/R switching menu x2.

Using a time setting menu x3, a user sets the use time of the air mattress 10, that is, the sleep time. However, the present invention is not limited to the case where the sleep time is set by a user, and the time setting is performed automatically based on the user's use time of the air mattress 10.

Using a user information input menu x4, a user inputs the body condition of a user, including the height, the weight, etc.

Referring to FIG. 14*b*, the air mattress system 1 provides the scored sleep quality to a user using the user terminal 30. The total score is displayed such that a user ascertains his or her sleep quality, and a graph of the sleep state of a user as a function of time is displayed. In addition, the total sleep time, the sleep time of the deep sleep state, the sleep time of the light sleep state, and the sleep time of the wake state are displayed.

Referring to FIG. 14*c*, there is shown a screen on which the sleep pattern provided to a user by the air mattress system 1 is displayed using the user terminal 30. The total sleep time and the time per sleep posture are displayed, such that a user ascertains his or her sleep pattern. For example, the time according to the user's posture such as the back posture, the side posture, the fetal posture, etc. is displayed. Based on this, the user's posture that has been maintained for most of the time is displayed as the main sleep posture.

Figure 15:
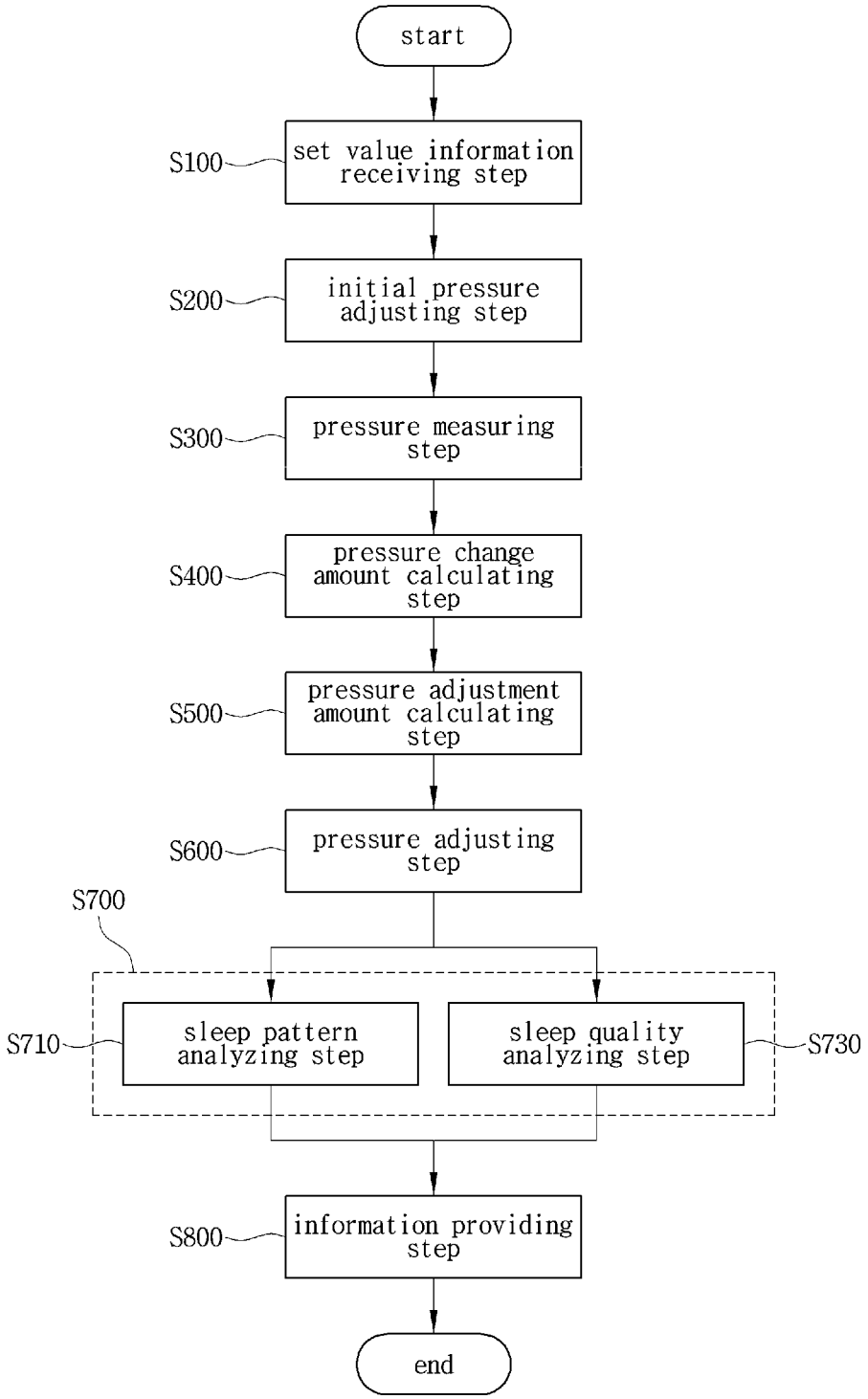
FIG. 15 is a flowchart showing a controlling method of an air mattress system according to an embodiment of the present invention.

FIG. 15 is a flowchart showing a controlling method of an air mattress system according to an embodiment of the present invention.

Referring to FIG. 15, there is included a set value information receiving step s100 of receiving, by the air mattress 10, the set value or the user information transmitted from the user terminal 30 through the mattress communication unit 16.

There is included an initial pressure adjusting step s200 of adjusting, by the mattress controller 13, the pressure of the air pockets 110 in each section of the multiple sections divided from the air pocket unit 11, based on the received set value or user information.

There is included a pressure measuring step s300 of measuring, by the pressure sensor unit 14, the pressure of the air pockets 110 in real time for each section, the pressure of the air pockets changing depending on a movement of a user.

There is included a pressure change amount calculating step s400 of calculating, by the pressure change amount calculating unit 19, the pressure change amount based on the pressure measurement value measured in real time.

There is included a pressure adjustment amount calculating step s500 of calculating, by the pressure adjustment amount calculating unit 20, the pressure adjustment amount based on the calculated pressure change amount.

There is included a pressure adjusting step s600 of controlling, by the mattress controller 13, the pressure of the air pockets 110 based on the pressure adjustment amount calculated by the pressure adjustment amount calculating unit 20.

In the pressure adjusting step s600, the mattress controller 13 adjusts the pressure of the air mattress 10 based on the pressure adjustment amount calculated by the pressure adjustment amount calculating unit 20.

However, in the initial pressure adjusting step s200, the pressure measuring step s300, the pressure change amount calculating step s400, the pressure adjustment amount calculating step s500, and the pressure adjusting step s600, the pressure of the air pockets 110 is measured or adjusted for each section of the multiple sections.

There is included a sleep information analyzing step s700 of receiving, by the server 50, the measurement data including the pressure measurement value, the pressure change amount, the sleep time, and the pressure adjustment amount for each section from the air mattress 10 to analyze the sleep pattern and the sleep quality of a user.

The sleep information analyzing step s700 includes a sleep pattern analyzing step s710 of analyzing, by the server 50, the sleep posture and the sleep time based on the measurement data received from the air mattress 10.

In the sleep pattern analyzing step s710, the sleep pattern analyzing unit 54 analyzes the sleep posture of the user by measuring, by the pressure sensor unit 14, the pressure in each section where the pressure increases. It is determined that a user lies on his or her side when the pressure change amount of the first section 11-1 is greater than the pressure change amount of other sections. Furthermore, it is determined that a user lies on his or her back when the pressure change amount of the third section 11-3 is greater than the pressure change amount of other sections.

There is included a sleep quality analyzing step s730 of dividing, by the server 50, the sleep state of a user into the deep sleep state, the light sleep state, and the wake state based on the measurement data received from the air mattress 10, determining the sleep state based on the measurement data, and analyzing the sleep quality.

There is included an information providing step s800 of receiving, by the user terminal 30, user's sleep information analyzed by the server 50 to provide the sleep information to a user.

Furthermore, although not shown in the drawings, the pressure of the air pockets 110 is adjusted for a mode of use according to a user's selection. For example, there are included a manual mode, a custom sleep mode, a first level-healthy sleep mode, a second level-healthy sleep mode, a first level-comfortable sleep mode, and a second level-comfortable sleep mode.

In the manual mode, a user manually adjusts the pressure intensity in the air pockets 110 and sets values.

In the custom sleep mode, the custom pressure calculating unit 21 described above calculates a custom pressure for each user to adjust hardness of the air mattress 10 according to a user.

The healthy sleep mode is a mode used by a user who has back problems or a user who feels uncomfortable when the hardness of the air mattress 10 is low and is used to increase the pressure intensity in the air pockets 110 to increase the hardness of the air pockets 110. The healthy mode includes multiple levels, such that a user is allowed to set the levels. As the levels increase, the hardness of the air pockets increases.

The comfortable sleep mode is a mode used by a user who desires the air mattress 10 having a low hardness and is used to decrease the pressure intensity in the air pockets 110 to decrease the hardness of the air pockets 110. The comfortable sleep mode includes multiple levels like the healthy sleep mode, such that a user is allowed to set the levels. As the levels increase, the hardness of the air pockets 110 increases.

Hereinafter, a method of operating the air mattress system 1 will be described as an example.

A user inputs the user information or the set value using the user terminal 30. Specifically, a user inputs the user's height and weight, or inputs a pressure adjustment range for setting the hardness of the air mattress 10 to the user terminal 30.

For example, the pressure adjustment range may range from 1 to 100 pa. This may be divided into five ranges. A first range that is the lowest pressure range may range from 1 to 20 pa. Sequentially, a second range may range from 21 to 40 pa, a third range may range from 41 to 60 pa, a fourth range may range from 61 to 80 pa, and finally a fifth range may range from 81 to 100 pa. The first range is the lowest pressure range, and thus the hardness of the air mattress 10 is set to be low. Thus, it is possible to realize a soft air mattress 10. Conversely, the fifth range is the highest pressure range, and thus the hardness of the air mattress 10 is set to be high, whereby it is possible to realize a rigid air mattress 10.

When a user inputs the user information such as the user's height and weight, the user terminal 30 transmits an optimal initial pressure value according to the body condition to the air mattress 10 based on database stored in the user terminal 30. For example, the user terminal 30 transmits the initial pressure value according to the body information input by a user to the air mattress 10, such that the hardness of the air mattress 10 maintains a medium pressure.

For example, when the weight is set to 60 to 90 kg based on an adult male, the air mattress system 1 sets the initial pressure value such that the pressure of the air pockets 110 is within the third range. In addition, when the weight is set to 90 to 120 kg based on an adult male, the air mattress system sets the initial pressure value such that the pressure of the air pockets 110 is within the second range.

As the load applied to the air pockets 110 increases, the pressure of the air pockets 110 increases, so that the initial pressure value of the pressure in the air pockets 110 is reduced as the user's weight increases.

Alternatively, when a user sets the pressure range rather than the user's body information using the user terminal 30, the user terminal 30 transmits the set pressure range to the air mattress 10. Thus, the air mattress 10 can adjust the pressure of the air pockets 110 based on the pressure range set by a user. For example, when a user inputs the third range (41 to 60 pa) as the set value, the initial pressure value of the air pockets 110 is set to 50 pa.

In a state where the initial pressure value is set to 50 pa, the pressure range of the air pockets 110 is maintained within the third range of 41 to 60 pa.

Specifically, the initial pressure value is set to 50 Pa, and the pressure that changes depending on the movement of a user is measured in real time. The pressure change amount measured is calculated on a predetermined time basis, based on the change pressure measurement value measured in real time. For example, the pressure change amount is calculated every ten minutes.

When the calculated pressure change amount exceeds 10 pa and is out of the preset lower limit value of 41 pa and the preset upper limit value of 60 pa, the pressure adjustment amount is calculated to adjust the calculated pressure change amount to be within the range of 41 to 60 pa. The pressure adjustment is performed based on the pressure adjustment amount, whereby the pressure value of the air pockets 110 is adjusted to be within the third range set by a user.

The air mattress 10 transmits information such as the pressure change amount, the pressure adjustment amount, etc. to the server 30.

The server 50 analyzes the sleep posture of a user based on the pressure change amount. The posture of a user is ascertained based on the pressure change amount for each section of the air mattress 10. For example, the sleep posture of a user is analyzed based on whether which section of the multiple sections is received a large load. Specifically, based on the pressure change amount for each section, the sleep posture is ascertained during the sleep time by dividing the posture of a user into the side posture, the back posture, the stomach posture, and the fetal posture. In addition, the maintaining time of each posture is ascertained to analyze the main sleep posture mainly taken by a user during the sleep time, and the time per sleep posture.

Thus, the main sleep posture taken by a user during the sleep time and the time per sleep posture are analyzed.

Furthermore, the server 50 determines whether the sleep state of a user is the deep sleep state, the light sleep state, or the wake state based on an average of the pressure change amount of the entire section to analyze and score the sleep quality of a user.

Specifically, when the average change rate of the pressure change amount of the entire section of the air pockets 110 is within the preset range A, it is determined that a user is in the deep sleep state. Furthermore, when the average change rate of the pressure change amount of the entire section of the air pocket unit 11 is within the preset range B, it is determined that a user is in the light sleep state. Furthermore, when the average change rate of the pressure change amount of the entire section of the air pocket unit 11 is within the preset range C, it is determined that a user is in the wake state.

In other words, the scores a, b, and c are respectively assigned to the ranges A, B, and C according to the average change rate of the pressure change amount of the entire section of the air pocket unit 110, and an average value is calculated based on the sleep time to score the sleep quality of a user.

Thus, the air mattress system 1 can adjust the hardness of the air pockets 110 during the user's sleep time so as to allow a user to have a comfortable sleep and can analyze the sleep pattern and the sleep quality of a user so as to provide the same to a user.

While the present invention has been particularly shown and described with reference to exemplary embodiments thereof, it will be understood by those of ordinary skill in the art that various changes and modifications may be made therein without departing from the technical spirit of the present invention. Therefore, the scope of the invention should be determined on the basis of the descriptions in the appended claims, not any specific embodiment, and all equivalents thereof should belong to the scope of the invention.

What is claimed is:

1. An air mattress system, comprising:

an air mattress configured to self-adjust its own pressure;

a user terminal receiving a set value or user information from a user and transmitting the set value or the user information to the air mattress; and a server receiving measurement data from the air mattress to analyze a sleep pattern and sleep quality of a user and transmitting the analyzed sleep pattern and sleep quality to the user terminal, wherein the air mattress is configured such that the air mattress is divided into multiple sections and the pressure is adjusted for each section based on the set value or the user information;

the air mattress comprises an air pocket unit including multiple air pockets each having a hollow portion formed therein and configured to inflate due to air inflow or to deflate due to air outflow; and the air pockets each comprising:

a top surface portion;

a contact portion protruding upwards from the top surface portion to support the user; and a side surface portion connected to the top surface portion, the side surface portion comprising:

a pair of first side surfaces facing each other, each of the pair of first side surfaces including a first inflation portion concavely formed toward the hollow portion; and a pair of second side surfaces facing each other, the pair of second side surfaces connected to the pair of first surfaces and having a width greater than the pair of first side surfaces, each of the pair of second side surfaces including a pair of second inflation portions, respectively, spaced apart from each other and concavely formed toward the hollow portion.

2. The air mattress system of claim 1, wherein the air mattress includes:

a body portion into which the air pocket unit is inserted;

a mattress controller mounted at the body portion and controlling pressure of the air pocket unit;

a pressure sensor unit measuring the pressure of the air pocket unit in real time; and an air pump supplying air into the air pockets.

3. The air mattress system of claim 2, wherein the air pocket unit is divided into:

a first section where a user's shoulder is configured to be located and formed by at least one row of the air pocket unit;

a second section where a user's waist is configured to be located and formed by at least one row of the air pocket unit;

a third section where user's buttocks are configured to be located and formed by at least one row of the air pocket unit; and a fourth section where user's thighs and knees are configured to be located and formed by multiple rows of the air pocket unit.

4. The air mattress system of claim 3, wherein the pressure sensor unit measures the pressure of the air pockets for each section of the first section, the second section, the third section, and the fourth section.

5. The air mattress system of claim 3, wherein the air mattress includes:

a sleep time measuring unit measuring a sleep time based on a time that the user uses the air mattress;

a pressure change amount calculating unit calculating a pressure change amount of the air pocket unit based on a pressure measurement value measured in real time by the pressure sensor unit during the sleep time of the user; and a pressure adjustment amount calculating unit calculating a pressure adjustment amount based on the calculated pressure change amount such that the pressure of the air pocket unit is within an optimum air pocket pressure range ranging from a preset lower limit value to a preset upper limit value that are determined based on the set value and the user information.

6. The air mattress system of claim 5, wherein in a section of the multiple sections where the pressure change amount is equal to or greater than the preset upper limit value, the pressure adjustment amount calculating unit calculates the pressure adjustment amount such that the pressure of the air pockets in the corresponding section is less than the preset upper limit value, and in a section of the multiple sections where the pressure change amount is equal to or less than the preset lower limit value, the pressure adjustment amount calculating unit calculates the pressure adjustment amount such that the pressure of the air pockets in the corresponding section is greater than the preset lower limit value.

7. The air mattress system of claim 6, wherein the mattress controller allows the air of the air pockets to be discharged in the section of the multiple sections where the pressure change amount is equal to or greater than the preset upper limit value, based on the pressure adjustment amount calculated by the pressure adjustment amount calculating unit, and allows the air to be supplied to the air pockets in the section of the multiple sections where the pressure change amount is equal to or less than the preset lower limit value, based on the pressure adjustment amount calculated by the pressure adjustment amount calculating unit, whereby the pressure of the air pockets is controlled to be within the optimum air pocket pressure range.

8. The air mattress system of claim 5, wherein the server includes:

a sleep pattern analyzing unit receiving the measurement data including the pressure measurement value, the pressure change amount, the sleep time, and the pressure adjustment amount for each section from the air mattress and analyzing the sleep time and a sleep posture based on the measurement data; and a sleep quality analyzing unit receiving the measurement data including the pressure measurement value, the pressure change amount, the sleep time, and the pressure adjustment amount for each section from the air mattress, classifying a sleep state of the user into a deep sleep state, a light sleep state, and a wake state, determining the sleep state based on the measurement data, and scoring the sleep quality.

9. The air mattress system of claim 8, wherein the sleep pattern analyzing unit analyzes the sleep posture of the user by measuring, by the pressure sensor unit, the pressure in each section where the pressure increases, wherein it is determined that the user lies on his or her side when the pressure change amount of the first section is greater than the pressure change amount of other sections, and it is determined that the user lies on his or her back when the pressure change amount of the third section is greater than the pressure change amount of other sections, whereby a main sleep posture taken by the user during the sleep time, and time per sleep posture are analyzed.

10. The air mattress system of claim 8, wherein the sleep quality analyzing unit determines that the user is in the deep sleep state when an average change rate of the pressure change amount of the entire section of the air pockets is within a preset range A, determines that the user is in the light sleep state when the average change rate of the pressure change amount of the entire section of the air pocket unit is within a preset range B, and determines that the user is in the wake state when the average change rate of the pressure change amount of the entire section of the air pocket unit is within a preset range C.

11. The air mattress system of claim 10, wherein the sleep quality analyzing unit assigns a score to each of the ranges A, B, and C according to the average change rate of the pressure change amount of the entire section of the air pocket unit and calculates an average value based on the sleep time to score the sleep quality of the user, wherein a score a is assigned to the preset range A, a score b is assigned to the preset range B, and a score c is assigned to the preset range C.

12. The air mattress system of claim 3, wherein the air mattress further includes a custom pressure calculating unit, wherein when the user lies on the air mattress, the custom pressure calculating unit measures a user's load for each section based on an initial pressure measurement value measured by the pressure sensor unit and calculates a pressure adjustment amount according to the user based on the user information or the measured load for each section.

* * * * *